US008457510B2

(12) United States Patent
Nanataki et al.

(10) Patent No.: US 8,457,510 B2
(45) Date of Patent: Jun. 4, 2013

(54) IMAGE FORMING APPARATUS, IMAGE INFORMATION GENERATION METHOD, AND COMPUTER PROGRAM

(75) Inventors: Hideo Nanataki, Yokohama-shi (JP); Kenichi Iida, Tokyo (JP); Keisuke Mitsuhashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 332 days.

(21) Appl. No.: 13/009,930

(22) Filed: Jan. 20, 2011

(65) Prior Publication Data

US 2011/0194866 A1 Aug. 11, 2011

(30) Foreign Application Priority Data

Feb. 5, 2010 (JP) ..... 2010-024502

(51) Int. Cl.
*G03G 15/08* (2006.01)

(52) U.S. Cl.
USPC ..... 399/53; 399/82

(58) Field of Classification Search
USPC ..... 399/53, 82, 15, 27, 28, 38–40, 49, 399/72, 75
See application file for complete search history.

(56) References Cited

U.S. PATENT DOCUMENTS

| | | | | |
|---|---|---|---|---|
| 5,600,412 | A * | 2/1997 | Connors | 399/81 |
| 6,895,195 | B2 | 5/2005 | Katamoto | |
| 7,634,210 | B2 * | 12/2009 | Soma et al. | 399/71 |
| 2003/0202808 | A1 | 10/2003 | Katamoto | |
| 2008/0170266 | A1 * | 7/2008 | Takahashi et al. | 358/3.1 |
| 2009/0136247 | A1 | 5/2009 | Nada et al. | |
| 2009/0202279 | A1 | 8/2009 | Saito et al. | |
| 2011/0135332 | A1 * | 6/2011 | Iida et al. | 399/53 |

FOREIGN PATENT DOCUMENTS

| | | | |
|---|---|---|---|
| JP | 10-337886 | A | 12/1998 |
| JP | 2004-005559 | A | 1/2004 |
| JP | 2005-001202 | A | 1/2005 |
| JP | 2010-044108 | A | 2/2010 |
| WO | 2010/016623 | A1 | 2/2010 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

The image forming apparatus includes an image forming section that forms a non-margin image by forming, on an image bearing member, a toner image including an edge portion area (Ae) and an internal area (Ai), transferring the toner image formed on the image bearing member to the transfer material. On the toner image corresponding to the edge portion area, which is formed on the image bearing member, toner amount increase processing is performed, the toner amount increase processing including toner amount gradual increase processing of gradually increasing intensity of the toner amount increase processing from the inner side of the edge portion area toward an outer side thereof. The image forming section forms, on the image bearing member, the toner image subjected to the toner amount increase processing. Accordingly, fixing performance during non-margin printing is enhanced and a high-quality image is formed.

11 Claims, 20 Drawing Sheets

FIG. 15

| FIG. 15A |
|---|
| FIG. 15B |

FIG. 15A

S804

| EXPERIMENT | PROCESSING | | COLOR | DATA [%] | | | | | PRINT IMAGE LEVEL | |
|---|---|---|---|---|---|---|---|---|---|---|
| | TONER AMOUNT INCREASE PROCESSING | TONER AMOUNT GRADUAL INCREASE PROCESSING | | Y | M | C | K | TOTAL | TONER CONTAMINATION OF TRANSFER MATERIAL BY OFFSET | DEGRADATION OF IMAGE |
| NO. 1 (THIS EMBODIMENT) | EXECUTED | EXECUTED | 1 | 10 | 8 | 15 | 60 | 93 | NOT OCCURRED | ALMOST INVISIBLE |
| | | | 2 | 20 | 17 | 30 | 80 | 147 | NOT OCCURRED | ALMOST INVISIBLE |
| | | | 3 | 30 | 25 | 45 | 100 | 200 | NOT OCCURRED | ALMOST INVISIBLE |
| | | | 4 | 13 | 60 | 0 | 0 | 73 | NOT OCCURRED | ALMOST INVISIBLE |
| | | | 5 | 27 | 80 | 0 | 0 | 107 | NOT OCCURRED | ALMOST INVISIBLE |
| | | | 6 | 40 | 100 | 0 | 0 | 140 | NOT OCCURRED | ALMOST INVISIBLE |
| | | | 7 | 57 | 40 | 0 | 0 | 97 | NOT OCCURRED | ALMOST INVISIBLE |
| | | | 8 | 83 | 60 | 0 | 0 | 143 | NOT OCCURRED | ALMOST INVISIBLE |
| | | | 9 | 93 | 80 | 0 | 0 | 173 | NOT OCCURRED | ALMOST INVISIBLE |
| NO. 2 (COMPARISON EXAMPLE 1) | EXECUTED | NOT EXECUTED | 1 | 10 | 8 | 15 | 60 | 93 | NOT OCCURRED | SLIGHTLY VISIBLE |
| | | | 2 | 20 | 17 | 30 | 80 | 147 | NOT OCCURRED | SLIGHTLY VISIBLE |
| | | | 3 | 30 | 25 | 45 | 100 | 200 | NOT OCCURRED | SLIGHTLY VISIBLE |
| | | | 4 | 13 | 60 | 0 | 0 | 73 | NOT OCCURRED | RECOGNITION IS WITHIN ALLOWABLE CRITERIA |

TO FIG. 15B

FIG. 15B

FROM FIG. 15A

| | | | | | | | | | | |
|---|---|---|---|---|---|---|---|---|---|---|
| | | | 5 | 27 | 80 | 0 | 0 | 107 | NOT OCCURRED | RECOGNITION IS WITHIN ALLOWABLE CRITERIA |
| | | | 6 | 40 | 100 | 0 | 0 | 140 | NOT OCCURRED | RECOGNITION IS WITHIN ALLOWABLE CRITERIA |
| | | | 7 | 57 | 40 | 0 | 0 | 97 | NOT OCCURRED | RECOGNITION IS WITHIN ALLOWABLE CRITERIA |
| | | | 8 | 83 | 60 | 0 | 0 | 143 | NOT OCCURRED | RECOGNITION IS WITHIN ALLOWABLE CRITERIA |
| | | | 9 | 93 | 80 | 0 | 0 | 173 | NOT OCCURRED | RECOGNITION IS WITHIN ALLOWABLE CRITERIA |
| NO. 3 (COMPARISON EXAMPLE 2) | NOT EXECUTED | NOT EXECUTED | 1 | 0 | 0 | 0 | 60 | 60 | OCCURRED | |
| | | | 2 | 0 | 0 | 0 | 80 | 80 | OCCURRED | |
| | | | 3 | 0 | 0 | 0 | 100 | 100 | OCCURRED | |
| | | | 4 | 0 | 60 | 0 | 0 | 60 | SLIGHTLY OCCURRED | |
| | | | 5 | 0 | 80 | 0 | 0 | 80 | SLIGHTLY OCCURRED | |
| | | | 6 | 0 | 100 | 0 | 0 | 100 | SLIGHTLY OCCURRED | |
| | | | 7 | 40 | 40 | 0 | 0 | 90 | SLIGHTLY OCCURRED | |
| | | | 8 | 60 | 60 | 0 | 0 | 120 | SLIGHTLY OCCURRED | |
| | | | 9 | 80 | 80 | 0 | 0 | 160 | SLIGHTLY OCCURRED | |

IMAGE FORMING APPARATUS, IMAGE INFORMATION GENERATION METHOD, AND COMPUTER PROGRAM

BACKGROUND OF THE INVENTION

1. Field of the Invention

The present invention relates to an image forming apparatus such as a copying machine or a printer that transfers a toner image formed on an image bearing member by an electrophotographic process to a transfer material, and then fixes the toner image to obtain a fixed image on the transfer material.

2. Description of the Related Art

There has been well known an electrophotographic image forming apparatus that includes a process of transferring a toner image formed on a surface of an image bearing member to a transfer material such as paper. A color image forming apparatus generally employs a configuration in which multiple photosensitive members are arranged in line so that toner images are sequentially formed by the respective photosensitive members and are transferred to a transfer material directly or via an intermediate transfer member.

Recent diversification of printer demands has been accompanied by a rise in request for non-margin printing in the color image forming apparatus in particular. There has conventionally been known a method in which a transfer material slightly larger than an image is used and margins thereof are cut after printing. To eliminate the cutting work, there is an increasing need for so-called non-margin printing, in which an image is printed on an entire surface of the transfer material without forming any margins on the edges of the transfer material beforehand.

For an ink-jet type of an image forming apparatus, an apparatus with a non-margin printing function has been brought to the market. Such an apparatus is disclosed in, for example, Japanese Patent Application Laid-Open No. H10-337886.

In an attempt to realize an electrophotographic full-color image forming apparatus that supports non-margin printing, there arises the following technical problem.

The toner image present in the edge portions of the transfer material is fixed under a condition different from that of the toner image in the conventional margin printing, and hence when the fixing operation is performed under the same condition, there is a fear that the obtained fixed image is not uniform and image contamination (hot offset) occurs because of fixing failure or excessive heating. In a case where the image contamination is prevented, there is a demand that image quality be maintained as high as possible.

SUMMARY OF THE INVENTION

In the above-mentioned regards, an object of the present invention is to obtain a good fixing performance during non-margin printing and to form a high-quality image.

Another object of the present invention is to provide an image forming apparatus, including an image forming section that forms a non-margin image by forming a toner image on an image bearing member, transferring the toner image formed on the image bearing member to the transfer material and inserting, into a fixing device, the transfer material to which the toner image is transferred, the toner image including an edge portion area in which an edge of a transfer material is to be in the edge portion area and an internal area defined inside the edge portion area; and a processing section that performs toner amount increase processing of increasing a toner amount, wherein on the toner image which corresponds to the edge portion area and is formed on the image bearing member, the toner amount increase processing of increasing the toner amount, the processing section performs the toner amount increase processing including toner amount gradual increase processing of gradually increasing the toner amount from the inner side of the edge portion area toward an outer side of the edge portion area, and wherein the image forming section forms the toner image subjected to the toner amount increase processing including the toner amount gradual increase processing in the edge portion area, on the image bearing member.

A further object of the present invention is to provide an image information generation method including generating image information used for forming a non-margin image by forming a toner image on an image bearing member, transferring the toner image formed on the image bearing member to the transfer material and inserting, into a fixing device, the transfer material to which the toner image is transferred, in an image forming apparatus, the toner image including an edge portion area in which an edge of a transfer material is to be in the edge portion area and an internal area defined inside the edge portion area; and performing, on the image information corresponding to the edge portion area, toner amount increase processing of increasing a toner amount of the toner image formed on the image bearing member, the toner amount increase processing including toner amount gradual increase processing of gradually increasing the toner amount from the inner side of the edge portion area toward an outer side of the edge portion area.

A further object of the present invention is to provide a computer program for causing a computer to execute processing of generating image information used for forming a non-margin image by forming a toner image on an image bearing member, transferring the toner image formed on the image bearing member to the transfer material and inserting, into a fixing device, the transfer material to which the toner image is transferred, in an image forming apparatus, the toner image including an edge portion area in which an edge of a transfer material is to be in the edge portion area and an internal area defined inside the edge portion area; and performing, on the image information corresponding to the edge portion area, toner amount increase processing of increasing a toner amount of the toner image formed on the image bearing member, the toner amount increase processing including toner amount gradual increase processing of gradually increasing the toner amount from the inner side of the edge portion area toward an outer side of the edge portion area.

A still further object of the present invention will become apparent from the following description of exemplary embodiments with reference to the attached drawings.

BRIEF DESCRIPTION OF THE DRAWINGS

FIG. 15 is comprised of FIGS. 15A and 15B showing tables illustrating comparative experiment results according to the first embodiment of the present invention.

DESCRIPTION OF THE EMBODIMENTS

First Embodiment

Image Forming System Diagram

Figure 1:
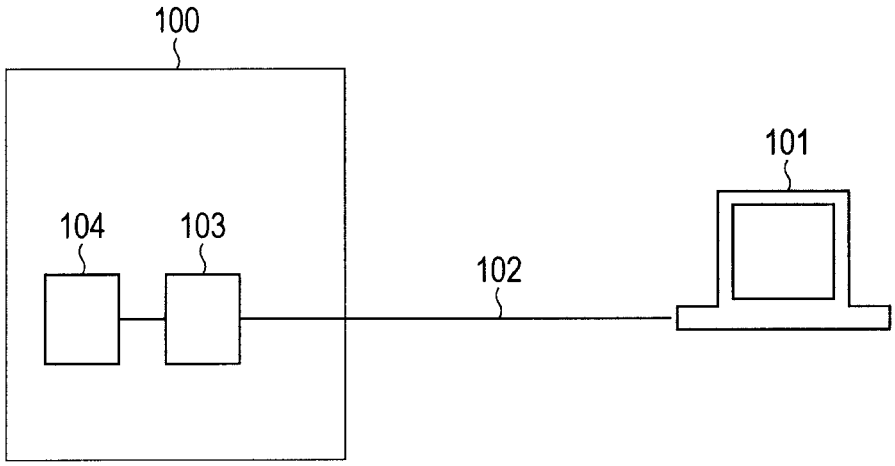
FIG. 1 illustrates an image forming system according to a first embodiment of the present invention.

FIG. 1 illustrates an image forming system in which an image forming apparatus and an image transmission apparatus are interconnected. As illustrated in FIG. 1, an image forming apparatus 100 of this embodiment is connected to a host computer 101 that is the image transmission apparatus via a cable 102. Image information is transmitted from the host computer 101 to a controller 103 via the cable 102, and then subjected to image data processing described later to be transmitted to a printer engine control unit 104.

The image forming apparatus 100 has a function of forming images in a non-margin printing mode that is a first image forming mode for performing non-margin printing on a transfer material P and in a margin printing mode that is a second image forming mode for performing normal margin printing on the transfer material P. The non-margin printing is called borderless printing, which means an image forming method in which an image is formed in the entire area of the transfer material. Hereinafter, the image forming mode for forming an image in the entire area of the transfer material is referred to as "non-margin printing mode". The image forming mode for forming an image in an area excluding a predetermined area, that is, four sides surrounding the transfer material, is referred to as "margin printing mode".

Configuration Diagram of Image Forming Apparatus

Figure 2:
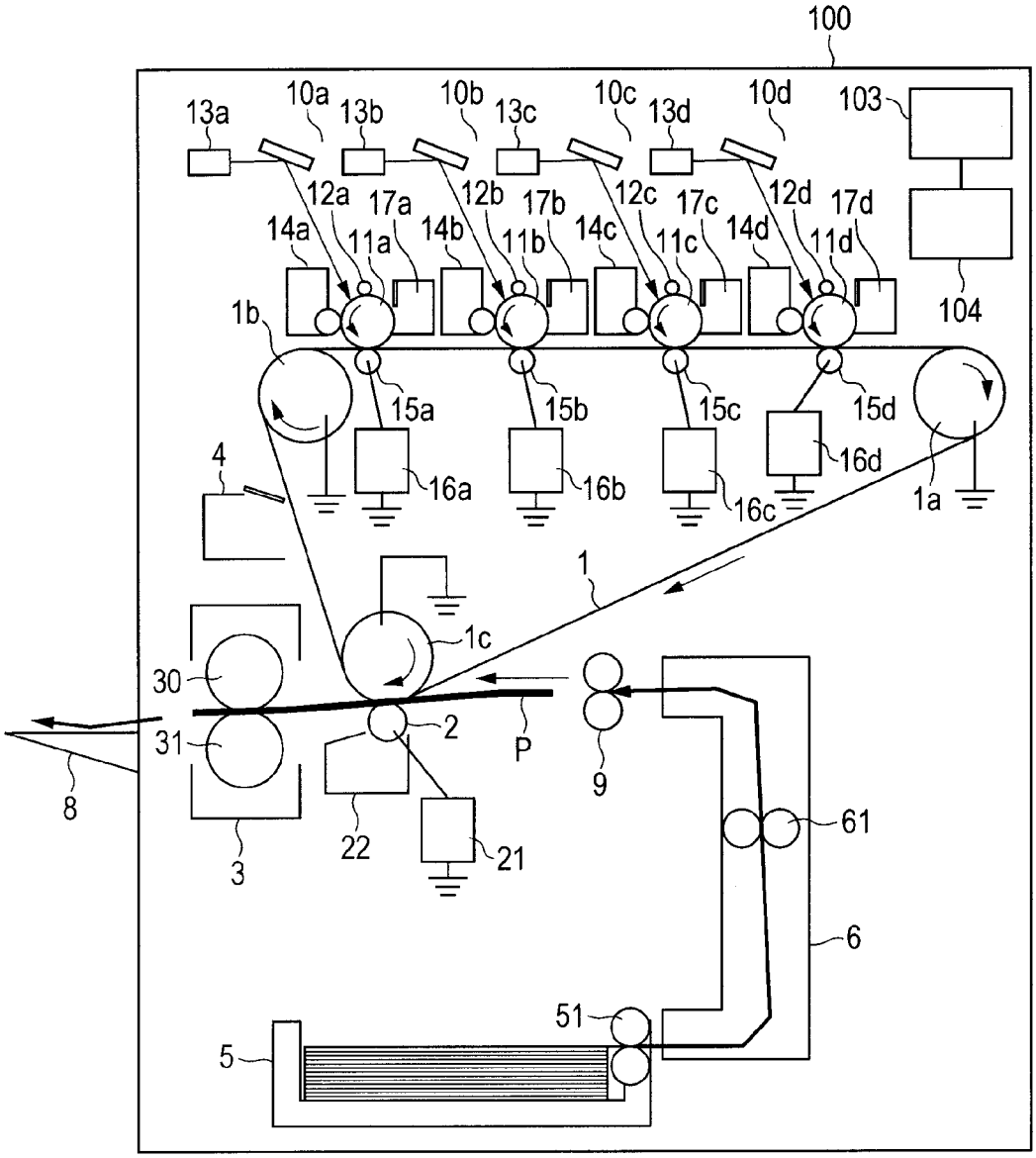
FIG. 2 illustrates a configuration of an image forming apparatus according to the first embodiment of the present invention.

FIG. 2 is a sectional view illustrating the image forming apparatus 100 of the first embodiment. As illustrated in FIG. 2, the image forming apparatus of this embodiment is described by using a full-color printer having four drums and employing an intermediate transfer method. The image forming apparatus includes four-color image forming sections (image forming stations 10) 10*a* to 10*d* of yellow (hereinafter, referred to as "Y" or "y"), magenta (hereinafter, referred to as "M" or "m"), cyan (hereinafter, referred to as "C" or "c"), and black (hereinafter, referred to as "K" or "k"), a transfer device that includes an intermediate transfer belt 1 as an intermediate transfer member, and a fixing device 3. However, the present invention is not necessarily limited to the four-color image forming apparatus. For example, the present invention can be applied to a six-color image forming apparatus that additionally includes light cyan and light magenta.

The image forming stations 10*a* to 10*d* are formed into image forming units, and photosensitive members (drum electrophotographic photosensitive members) 11*a* to 11*d* serving as image bearing members are installed so as to freely rotate in arrow directions. On the outer peripheral surfaces of the photosensitive members 11*a* to 11*d*, primary charging rollers 12*a* to 12*d* are disposed to uniformly charge the surfaces of the photosensitive members. On the downstream side of the primary charging rollers 12 in the photosensitive member rotation direction, laser exposure devices 13*a* to 13*d* are disposed to expose the surfaces of the photosensitive members by emitting (casting) laser beams modulated corresponding to image information to the surfaces of the photosensitive members. On the downstream side of the laser exposure devices 13, developing devices 14*a* to 14*d* are disposed to develop electrostatic latent images of respective colors formed on the surfaces of the photosensitive members by laser exposure, by using toner of corresponding colors of yellow, magenta, cyan, and black.

At positions (transfer positions) of the photosensitive members 11*a* to 11*d* sandwiching the intermediate transfer belt 1, primary transfer rollers 15*a* to 15*d* are opposingly installed to form primary transfer portions with the photosensitive members. Primary transfer power sources 16*a* to 16*d* are connected to the primary transfer rollers 15*a* to 15*d*, and variable primary transfer voltages Vy, Vm, Vc, and Vk are applied thereto.

The intermediate transfer belt 1 is stretched around three rollers, that is, a drive roller 1*a*, a tension roller 1*b*, and a secondary transfer opposed roller 1*c*, and vertically put through the image forming stations 10*a* to 10*d* to be brought into contact with the photosensitive members 11*a* to 11*d*. The intermediate transfer belt 1 is rotatably driven in the arrow direction of FIG. 2 by the drive roller la. Drum cleaners 17*a* to 17*d* are installed on the downstream side of the primary transfer rollers 15*a* to 15*d* of the photosensitive members 11*a* to 11*d*. A belt cleaner 4 is disposed on a surface of the intermediate transfer belt 1.

The printer engine control unit 104 controls each portion of a printer engine according to image information or various instructions received from the controller 103. The printer engine substantially refers to parts of the image forming apparatus 100 of FIG. 2 excluding the controller 103 and the printer engine control unit 104, which perform operations regarding image formation.

An image forming operation of the image forming apparatus thus configured is described below by taking an example of the yellow image forming station 10*a*. The photosensitive member 11*a* of the yellow image forming station 10*a* includes a photoconductive layer formed on an aluminum cylindrical surface, and its surface is uniformly charged to be minus (charge potential=−600 V) by the primary charging roller 12*a* during the rotation in the arrow direction. Subsequently, image information sent from the host computer 101 is converted into laser emission intensity or time by image data processing described later, and the laser exposure device 13*a* executes image exposure (surface potential after exposure=−200 V). As a result, an electrostatic latent image corresponding to a yellow image component of an original image is formed on the surface of the photosensitive member 11*a*. This electrostatic latent image is developed by the developing device 14*a* by using yellow toner minus-charged to be visualized as a yellow toner image.

The obtained yellow toner image is primarily transferred to the intermediate transfer belt 1 by applying a primary transfer voltage to the primary transfer roller 15*a* from the primary transfer power source 16*a*. The photosensitive member 11*a* after the transfer is put to use for next image formation by removing transfer residual toner adhering to the surface thereof by the drum cleaner 17*a*.

Such an image forming operation is carried out at the image forming stations 10*a* to 10*d* at predetermined timings, and toner images on the photosensitive members 11*a* to 11*d* are sequentially stacked on the intermediate transfer belt 1 to be primarily transferred by the primary transfer portions. In a full-color mode, toner images are sequentially transferred to the intermediate transfer belt 1 in an order of yellow, magenta, cyan, and black. In a monochrome mode, black toner images are transferred in the same order as that of the above. Then, following rotation of the intermediate transfer belt 1 in the arrow direction, the four-color toner images on the intermediate transfer belt 1 are moved to a secondary transfer nip portion abutting the secondary transfer opposed roller 1*c* with which a secondary transfer roller 2 is installed sandwiching the intermediate transfer belt 1. A secondary transfer power source 21 applies a secondary transfer voltage to the secondary transfer roller 2 brought into contact with the transfer material P fed from feed rollers 9 at a predetermined timing. Thus, the toner images are secondarily transferred collectively to the transfer material P. Transfer residual toner adhering to the surface of the intermediate transfer belt 1 after the secondary transfer is removed by the belt cleaner 4, and the intermediate transfer belt 1 is put to use for next image formation.

The transfer material P, which has passed through the secondary transfer nip portion to have the unfixed toner image transferred thereto, is conveyed (inserted) to the fixing device 3, and the unfixed toner image is heated and pressurized to become a fixed image. The transfer material P delivered from the fixing device 3 is delivered to a delivery tray 8 disposed outside the apparatus.

Image Forming Areas in Margin Printing Mode and Non-Margin Printing Mode

Figure 3A:
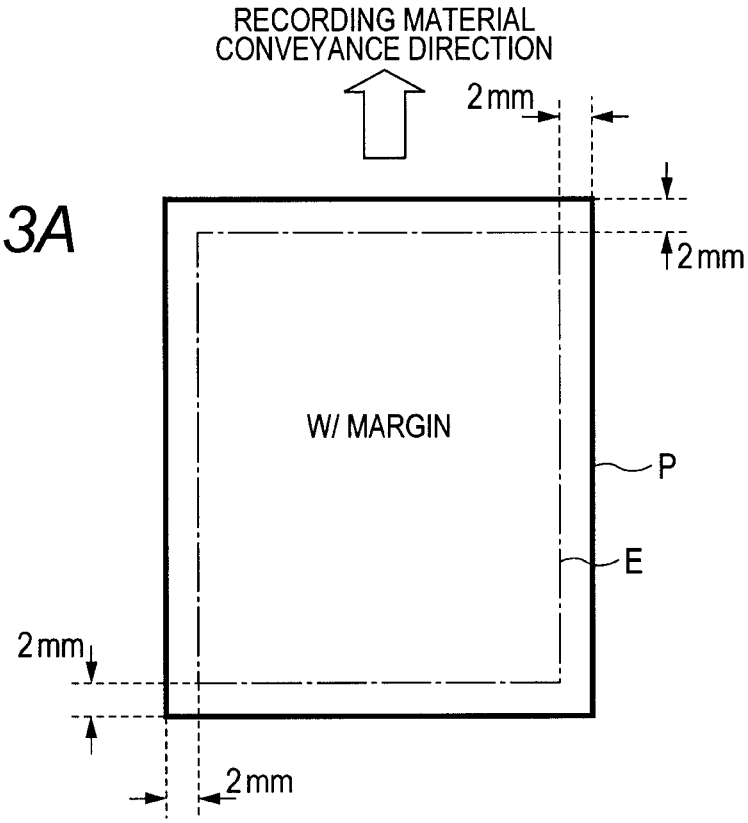
FIGS. 3A and 3B illustrate a relationship between an image size and a transfer material size in the image forming apparatus according to the first embodiment of the present invention.
Figure 3B:
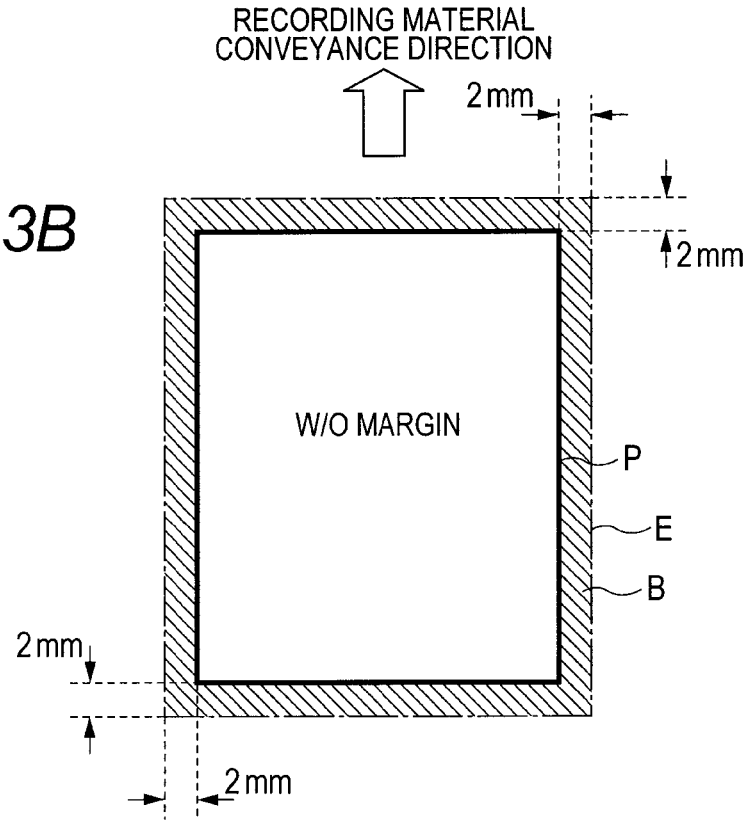

Referring to FIGS. 3A and 3B, an expanded image forming area for the transfer material P in the non-margin printing mode is described.

In the image forming apparatus, when margin printing is carried out on the transfer material P, a mask area E defining a printing area with respect to a size of the transfer material P is an area illustrated in FIG. 3A. In other words, the area covers a range from the center of the transfer material P up to 2-mm inner positions from the leading, trailing, left, and right edges of the transfer material P. At a timing inside the mask area E, each of the laser exposure devices 13 emits a laser beam based on image data so as to form an electrostatic latent image for developing the visible toner image on the photosensitive drum.

On the other hand, when non-margin printing is carried out on the transfer material P, the mask area E is expanded compared to the case where the margin printing is carried out, to thereby become an area illustrated in FIG. 3B. Specifically, the area is larger than the transfer material P by an amount equal to an expanded image forming area B having a width of 2 mm in each of the leading, trailing, left, and right edges of the transfer material P.

In a contact of the secondary transfer portion between the intermediate transfer belt 1 and the transfer material P, a moving speed difference may occur due to mechanical precision or transfer efficiency. For example, a moving speed of the transfer material P may be higher than that of the intermediate transfer belt 1. In this case, a moving-direction length of an image after secondary transfer to the transfer material P is larger. Thus, in such a case, toner images (electrostatic latent images) are formed on the photosensitive members 11*a* to 11*d* so that an expanded image forming area having a width of 2 mm can be formed in each of the leading and trailing edges of the expanded image forming area B described above after secondary transfer.

Thus, an image including an image portion of the expanded image forming area B is formed on the photosensitive member, primarily transferred to the intermediate transfer belt 1, and then secondarily transferred to the transfer material P. During the secondary transfer process, even if a positional relationship slightly shifts between the image on the intermediate transfer belt and the transfer material P, because the expanded image forming area is provided, a non-margin print image is obtained on the transfer material P without failure.

During secondary transfer, a part of the toner image in the expanded image forming area outside the transfer material P adheres to the secondary transfer roller 2. This toner is removed by a secondary transfer roller cleaner 22 abutting the secondary transfer roller 2.

In this way, a non-margin full-color image having four-color toner images transferred and fixed can be obtained on the transfer material P.

Offset

A status of the trailing edge portion of the transfer material P after the transfer material P enters the fixing device 3 is considered below.

Figure 4:
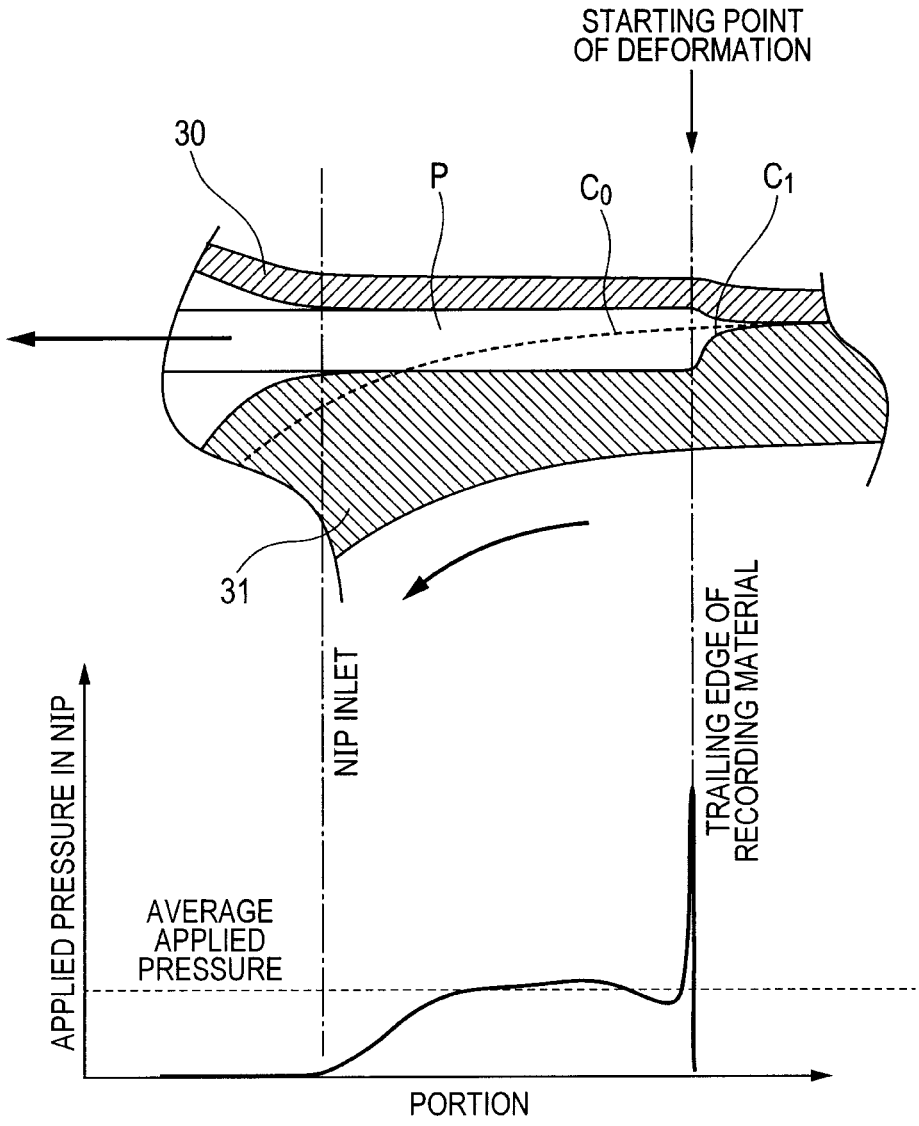
FIG. 4 is a schematic diagram illustrating a status of a trailing edge portion of a transfer material in a fixing nip.

FIG. 4 is a schematic diagram illustrating a status immediately before the trailing edge of the recording material is delivered from a fixing nip portion, and illustrates an applied pressure distribution at this time. The applied pressure distribution may be obtained by measurement performed with a pressure sensitive film inserted along with the recording material P. The applied pressure distribution shows that a pressure higher than usual is applied at a position corresponding to the trailing edge of the recording material P. This is possibly because the edge portion of the recording material P serves as a starting point of receiving a force of deformation from an elastic layer of a pressure roller 31 and a high pressure is therefore applied locally. When considered by using the model, as compared to a virtual surface line C0 of the pressure roller 31 of FIG. 4, the elastic layer of the pressure roller 31 is actually deformed as indicated by a deformed surface line C1, and the edge portion of the transfer material P is supposed to concentrically receive a restoring force of the pressure roller 31 on its downstream side. The virtual surface line C0 refers to a line in which the fixing roller 31 is elastically deformed and brought into contact with a fixing film 30 when the transfer material P is not present in the fixing nip portion.

Figure 5:
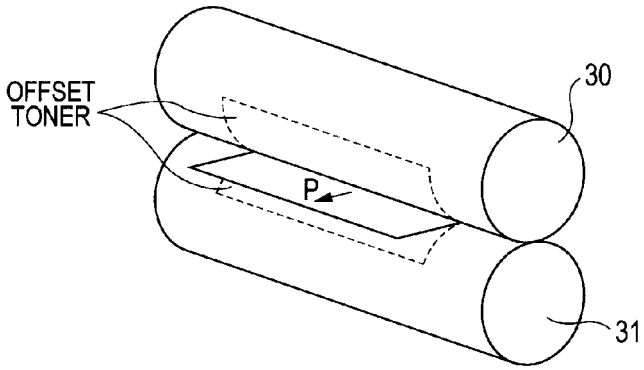
FIG. 5 is a perspective view illustrating a toner offset status.

It is generally considered that fixing performance is determined based on two elements, that is, temperature and applied pressure. Temperature is an essential condition for heating and fusing toner while applied pressure is a promoting condition for efficiently performing the heating and fusing operation. Thus, when the fixing film 30 is maintained at the same temperature but the applied pressure is different, different fixing performance is obtained. Specifically, the heating temperature that is optimally set relative to a normal applied pressure (average applied pressure of FIG. 4) leads to excessive heat supply in the local high-pressure portion. As a result, toner is excessively fused to have a higher affinity for the surface of the fixing film 30, and accordingly a hot offset phenomenon in which toner contaminates the surface of the fixing film 30 may easily occur. In the non-margin printing mode, the hot offset may easily occur in the edge portion of the transfer material, and when the hot offset occurs in each of the edge portions of the recording material P, image contamination occurs because of the hot offset in a frame shape as illustrated in FIG. 5. The above-mentioned phenomenon similarly occurs in the leading edge of the transfer material P as well as in the trailing edge of the transfer material P. A similar phenomenon is observed also in the left and right edges of the transfer material P even to a smaller extent than the case of the trailing edge.

In this embodiment, the toner contamination of the transfer material caused by the offset has the following characteristics.

(1) The toner contamination tends to occur when a total toner amount of respective colors for forming an image transferred to the edge portion of the transfer material is not so large. In general, an amount of heat necessary for fixing depends on the toner amount within the toner image, and as the toner amount is larger, the necessary amount of heat is larger. Thus, when a toner image having a small toner amount is present in the edge portion of the transfer material, the amount of heat supplied to the toner tends to be excessive, resulting in a hot offset. Meanwhile, the toner amount that causes the offset depends on a toner amount of the original toner image, and hence the contamination is not so conspicuous when the toner amount is small. Thus, the contamination easily occurs in a toner image in which a certain amount of toner is at middle density that causes the hot offset to easily occur. This tendency also means that the image contamination easily occurs when a monochrome toner image is present in the edge portion of the transfer material.

(2) A color of toner for forming an image transferred to the edge portion of the transfer material changes an apparent toner contamination level of the transfer material. On a normally used white transfer material, black toner is most conspicuous, and magenta and cyan are second and third most conspicuous in this order. Yellow toner is not so conspicuous.

Thus, by performing processing of increasing the toner amount (toner amount increase processing) on the toner image in which the hot offset easily occurs and the image contamination is likely to be conspicuous, the amount of heat necessary for fixing is increased, with the result that the hot offset can be suppressed and the image contamination can be reduced.

The characteristics are as described above in this embodiment but, for example, the characteristic (2) is not always limited to the above. When toner characteristics or image process conditions are different, for example, a contamination level of cyan caused by the offset may be largest. In such a case, in this embodiment, the cyan may be set as a target color image for the toner amount increase due to a high offset level, and image processing may be carried out to increase, for example, the toner amount of Y, which is relatively lower in visibility. When another toner color low in visibility is set in the image forming apparatus, the amount of toner may be increased by using the another color low in visibility.

Controller 103

Figure 6:
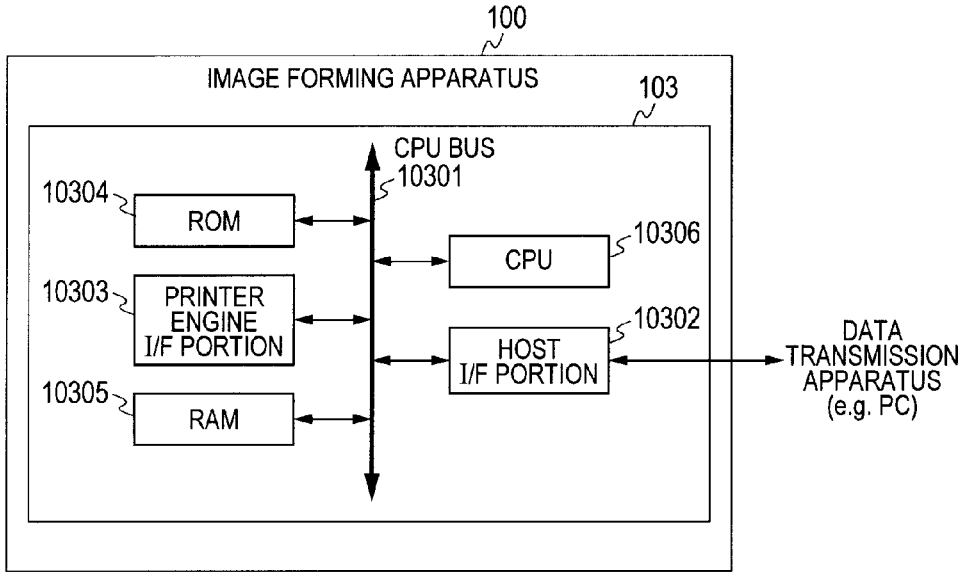
FIG. 6 illustrates a configuration of a controller included in the image forming apparatus according to the first embodiment of the present invention.

Referring to FIG. 6, the controller 103 described referring to FIG. 1 is described in more detail.

The controller 103 includes devices such as a host I/F portion 10302, a printer engine I/F portion 10303, a ROM 10304, a RAM 10305, and a CPU 10306, which are interconnected via a CPU bus 10301. The CPU bus 10301 includes addresses, data, and control buses.

The host I/F portion 10302 has a function of communicating and connecting with a data transmission apparatus such as a host computer via a network in two ways. The printer engine I/F portion 10303 has a function of communicating and connecting with the printer engine control unit 104 in two ways. The controller 103 transmits image information and gives various instructions to the printer engine control unit 104 via the printer engine I/F portion 10303.

The ROM 10304 holds control program codes for executing processing of the present invention (image data processing of toner amount increase processing described later) and other processing. The RAM 10305 is a memory for holding bitmap data of a rendering or color-converting result of image information received by the printer engine I/F portion 10303, a temporary buffer area or various processing statuses. The CPU 10306 controls the devices connected to the CPU bus 10301 based on the control program codes held in the ROM 10304.

Hereinafter, processing of the CPU 10306 is mainly described. However, the configuration of the controller 103 described above is only an example, and thus not always limited thereto. For example, an application specific integrated circuit (ASIC) or a system-on-chip (SOC) may be installed in the controller 103 to perform a part or all of the processing of the CPU.

Image Data Processing

Figure 7:
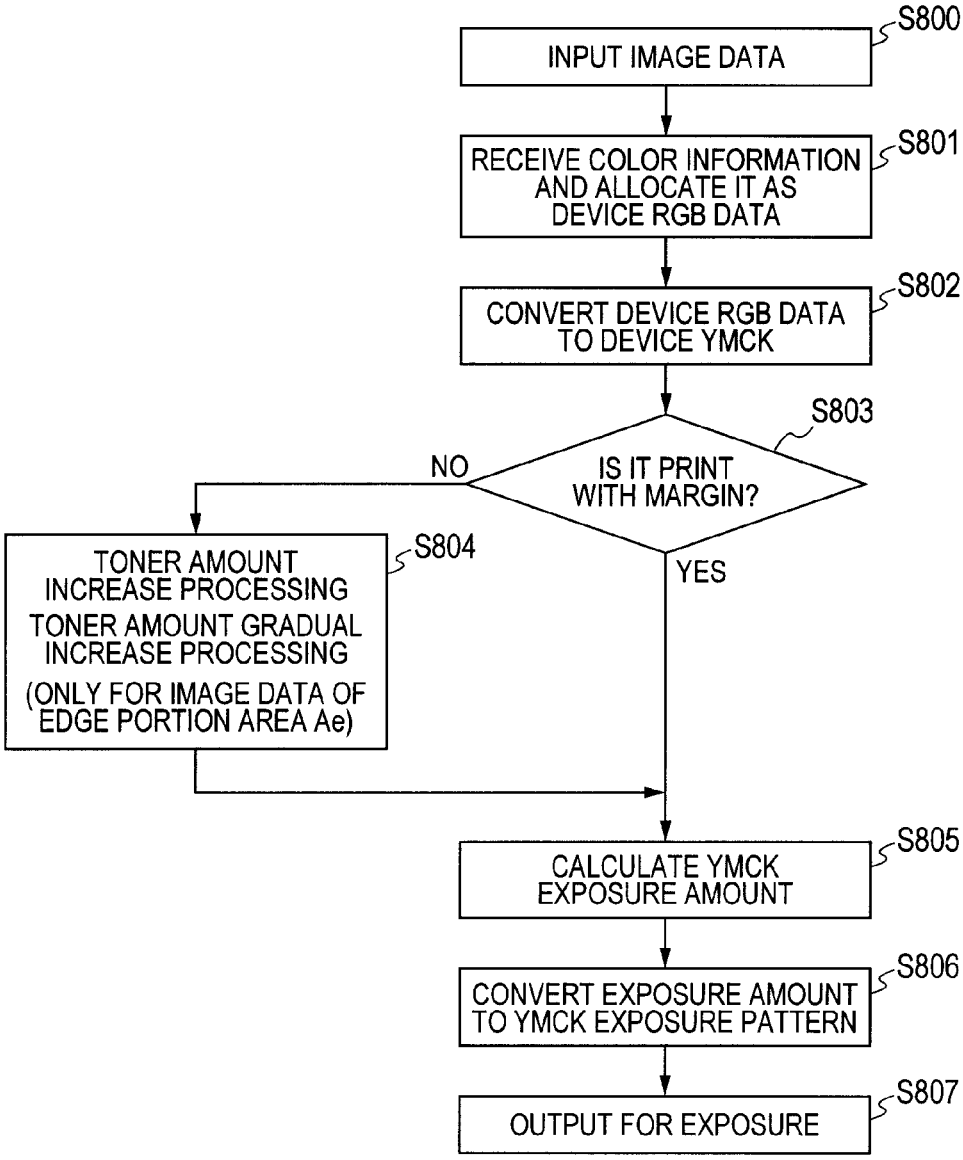
FIG. 7 is a flow chart of image processing performed in the image forming apparatus according to the first embodiment of the present invention.

Referring to a flow chart of FIG. 7, the image data processing in the image forming apparatus is described. In the processing described below, the CPU 10306 loads the control program stored in the ROM 10304 to the RAM 10305 to execute the control program.

First, in Step S800, image information and various pieces of print setting information such as a paper size and an operation mode, which are transmitted from the host computer 101 via a network, are received. The image information and various pieces of print setting information may be referred to as print job data. The operation mode includes at least the "margin printing mode" and the "non-margin printing mode" described referring to FIG. 1.

When the image information regards a color image, a color information format of red, green, and blue (RGB) data is employed. In Step S801, each color information is allocated as device RGB data reproducible by the apparatus to be converted.

In Step S802, the color information of the image information is converted from the device RGB data into device yellow, magenta, cyan, and black (YMCK) data. Each gradation value of the device YMCK data is defined as a ratio (0% to 100%) of a toner amount to a toner amount per unit area transferred to the transfer material when the laser of the image forming station of each color is totally lit (100% lit). For example, when a laser beam is cast to the photosensitive member according to Y data of 50%, toner of half the weight of the case where a laser beam is cast according to data of 100% is transferred to the transfer material as a result.

When it is determined in Step S803 that the margin printing mode is selected, the process proceeds to Step S805 after Step S802. Before proceeding to Step S805, for the image information, conventionally known image processing may be executed to reduce an offset assuming margin printing. Alternatively, no image processing assuming an offset may be executed.

In Step S805, for the device YMCK data, exposure amounts of the YMCK colors are calculated by using a gradation table indicating a relationship between exposure amounts of respective colors and actually used toner amounts.

In Step S806, for each pixel, an exposure amount (laser beam emission amount) of each color is converted into an actually used exposure pattern (light emission pattern). The laser exposure devices 13 corresponding to respective colors perform output for exposure (output for emission) (Step S807). As described above, the exposure of the YMCK colors is performed by the laser exposure devices 13*a* to 13*d*. The electrophotographic process after the laser exposure is performed on the surface of the photosensitive member is as described above referring to FIG. 2, and detailed description thereof is therefore omitted herein.

In the case of the non-margin printing mode, as described referring to FIGS. 3A and 3B, the expanded image forming area is disposed for the transfer material P and an image forming operation is carried out. In this case, it is determined in Step S803 that the non-margin printing mode is selected, Step S804 is executed after Step S802, and then the process proceeds to Step S805.

Toner Amount Increase Processing (Step S804)

Figure 8A:
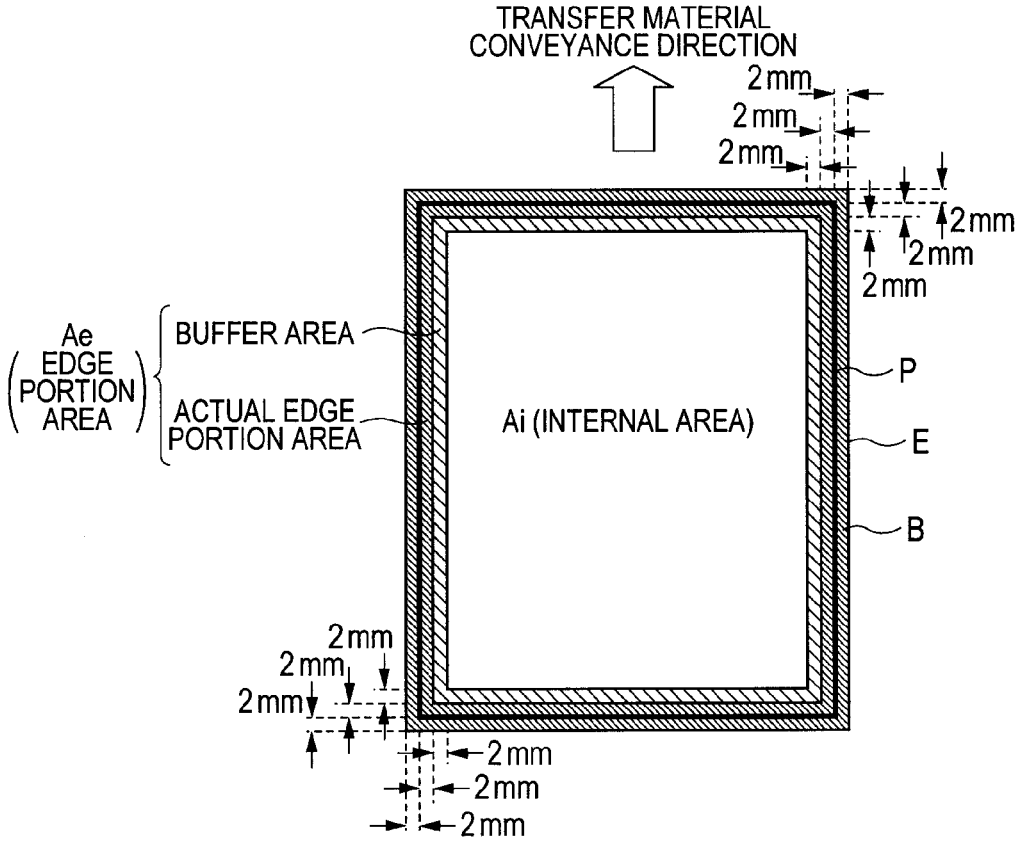
FIGS. 8A and 8B illustrate image processing areas in the image forming apparatus according to the first embodiment of the present invention.

In the non-margin printing mode, as illustrated in FIG. 8A, the CPU 10306 performs processing of increasing a toner amount for, in an image formed on the photosensitive drum on the entire surface in the mask area E, image information included in an edge portion area Ae of the transfer material P. More specifically, when performing the toner amount increase processing on the toner image to be formed on the image bearing member, the CPU 10306 performs image processing including toner amount gradual increase processing, in which the degree of the toner amount increase is gradually increased. As an example of the gradual increase in degree of the toner amount increase, gradual increase in toner amount in stages is conceivable. Further, pseudo half tone processing such as dithering or error diffusion may be performed on the image information to form in the image information a gradation in which the density smoothly increases, thereby performing the toner amount gradual increase processing. Hereinafter, the case of gradually increasing the toner amount in stages is described as the processing of gradually increasing the toner amount, but the processing is not limited thereto as described above. For an internal area Ai, image processing or measures are taken in the same way as in the case where the determination in Step S803 is "No".

Figure 8B:
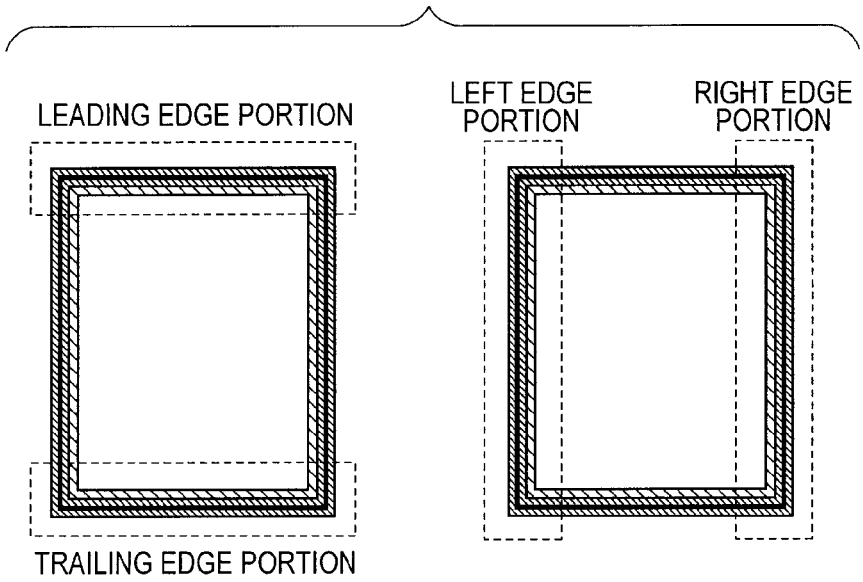

The edge portion area Ae includes four portions, that is, a leading edge portion, a trailing edge portion, a left edge portion, and a right edge portion. The leading edge portion, the trailing edge portion, the left edge portion, and the right edge portion are as illustrated in FIG. 8B. In this embodiment, when the edge portion area Ae is subjected to the above-mentioned toner amount increase processing for reducing the offset, in order to prevent a feeling of strangeness even if the toner images before and after the toner amount increase processing are adjacent to each other, gradual increase processing is performed to gradually increase the intensity of the toner amount increase processing from the inner side of the edge portion area Ae toward the outer side thereof. The starting position of the toner amount gradual increase processing (gradual increase processing starting position) is determined so that the toner amount increase processing effective in reducing the offset is applied to the toner image in the edge portion of the transfer material P even if the positional relationship between the image and the transfer material P shifts during the printing operation. In this embodiment, it is assumed that the shift amount is ±2 mm, and hence the edge of the transfer material may be positioned in an image in a 4-mm area inside the edge of the mask area (actual edge portion area). Therefore, the actual edge portion area is subjected to the toner amount increase processing of the maximum intensity, and a 2-mm area inside the actual edge portion area is set as a buffer area for gradually increasing the intensity of the toner amount increase processing toward the actual edge portion area. Accordingly, as illustrated in FIG. 8A, the edge portion area Ae of this embodiment is set as the 6-mm area ranging from the 4-mm inner position from the center of each of the leading, trailing, left, and right edges of the transfer material P up to the 2-mm outer position therefrom.

When a width of the actual edge portion area is twice as large as a protruding width of a toner image from the transfer material with no shifting occurrence in positional relationship between the image (toner image) and the transfer material, this status can be efficiently dealt with. In other words, any shifting in positional relationship between the image and the transfer material P can be flexibly dealt with, wasting no toner.

When the buffer area is increased in width, the area of a large toner consumption amount increases as compared to the original toner image, and hence it is preferred that the width is limited to about 1 mm to 3 mm so that a smooth change is obtained in the processing performed in multiple stages.

On the other hand, the internal area Ai is another area in the mask area E, in other words, an area ranging from the center of the transfer material P (image) up to 4-mm inner positions from the leading, trailing, left, and right edges of the transfer material P.

In the edge portion area Ae, a total value of data of respective colors is increased for the device YMCK data determined in Step S802, and processing of gradually increasing the intensity of the toner amount increase toward the actual edge portion area is performed. This processing is not performed in the internal area Ai.

Figure 9:
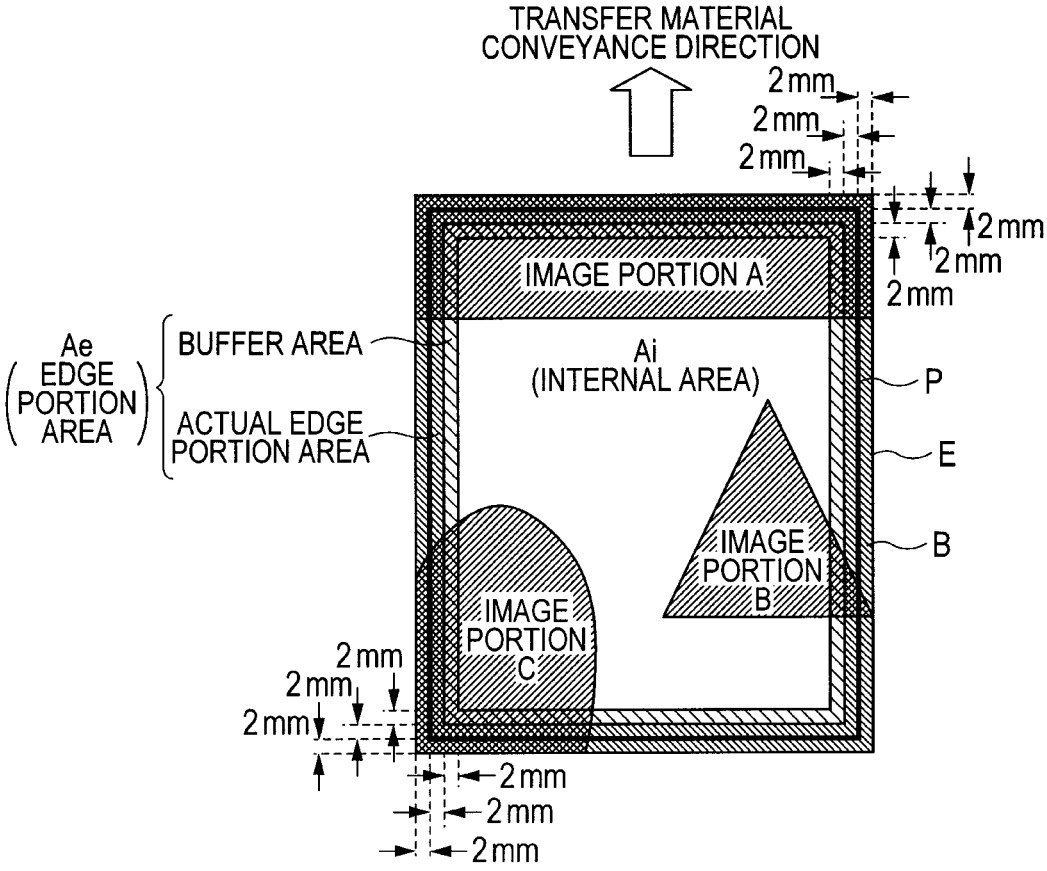
FIG. 9 illustrates a relationship between the image processing area and an image pattern in the image forming apparatus according to the first embodiment of the present invention.

For example, a case where image formation is carried out by a pattern having image portions A, B, and C, such as an image pattern illustrated in FIG. 9, in other words, a pattern having image portions present in both the edge portion area Ae and the internal area Ai, is described. This pattern includes image portions not only between the mask area E of FIG. 3A and the mask area E of FIG. 3B but also inside the transfer material. In this case, Step S804 is executed only for image information of pixels included in the edge portion area Ae among image pixels constituting each image portion. Step S804 is not executed for image information of pixels included in the internal area Ai.

Specific Example 1 of Toner Amount Increase Processing

As an example of the toner amount increase processing in Step S804, referring to graphs of FIG. 10A and FIGS. 12A to 12C, processing for a color belonging to a single K color group in which the device YMCK data determined in Step S802 is Y=M=C=0% and K=0% to 100% is described. The device YMCK data is represented in terms of percentage corresponding to the value of a gradation of the device YMCK data. For example, to represent a gradation by 8 bits, FFhex, which represents the highest density, is 100%. Hereinafter, a gradation of color data is represented by using "%" unless otherwise specified. This representation also applies to other embodiments. In actual image formation, cases other than that of Y=M=C=0% and K=100% are possible. However, for K image information, toner amount increase processing illustrated in FIG. 10A may always be carried out.

Figure 10A:
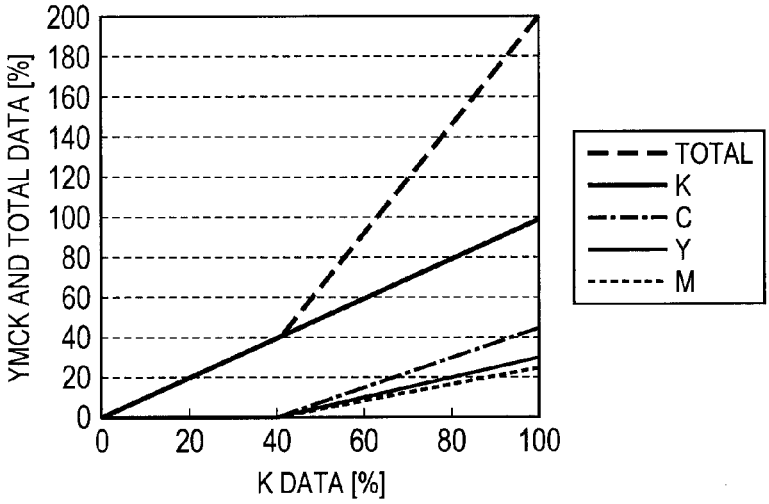
FIGS. 10A, 10B, and 10C illustrate a color conversion relationship of the image processing performed in the image forming apparatus according to the first embodiment of the present invention.

In the graph of FIG. 10A, with regard to the toner amount increase processing of the maximum intensity that is applied to the toner image in the actual edge portion area, the abscissa indicates a gradation of original K data determined in Step S802. Further, the ordinate indicates a gradation of the device YMCK data and total data of respective colors which are newly determined in Step S804. When the abscissa indicates an input value, the ordinate indicates an output value corresponding to the input value, and the same applies to all of FIGS. 12A, 12B, 12C, 13, 14, 16A, 16B, 18A, 18B, 18C, 19A, 19B, and 19C that are referred to later. The ROM 10304 stores tables having a function of converting the data into the graphs or other such sections equivalent thereto, and the CPU 10306 refers to those tables and executes the processing of increasing the toner amount in Step S804 (image processing).

Referring back to FIG. 10A, when the original K data is 0% to 40%, the K data is maintained as it is. When the original K data is 40% to 100%, in other words, when the gradation of the original K data exceeds a threshold value, in addition to the original K data, YMC data of about 0% to 45% of respective colors are added. In this case, the total data of the respective colors is as shown in the graph.

For example, data pieces of respective colors (Y, M, C, and K) are each treated as 1-byte data for processing performed in the controller 103. In other words, a data value of 0% is 00hex, a data value of 100% is FFhex, and values therebetween are linearly interpolated in 00hex to FFhex. For example, when original image data is K data of 80%, the data is treated as CChex. As to the data determined in Step S804, based on the relationship of FIG. 10A, Y data is 33hex (20%), M data is 2Bhex (17%), C data is 4Chex (30%), and K data is CChex (80%).

Even in the case of the color belonging to the single K color group, when an image of a color at a gradation of about 40% to 100% of the K data is present in the edge portion of the transfer material, image contamination due to the hot offset easily occurs (in the gradation of about 0% to 40% of the K data, the original toner amount is small, and hence the toner amount that causes the offset is also small and the image contamination is not conspicuous). The toner color is black, and hence the toner contamination of the transfer material when the offset occurs is likely to be conspicuous.

When the edge portion area of the K data thus input is about 40% to 100%, adding the YMC data corresponding to the edge portion area and increasing the total data of the respective colors to perform printing enable suppression of occurrence of toner contamination of the transfer material P caused by the offset at any gradations.

This is because the total amount of toner for forming an image in the edge portion of the transfer material is increased to suppress occurrence of the hot offset, and the image contamination can be prevented from being conspicuous even if the offset occurs by using mixing color toner of YMC relatively lower in visibility on the transfer material P than K toner as toner to be increased.

In this processing, the YMC toner that becomes a process black color when mixed together is only added to the black color. Thus, chromaticity changes are suppressed to lower values as compared to the image color before the processing.

Figure 11:
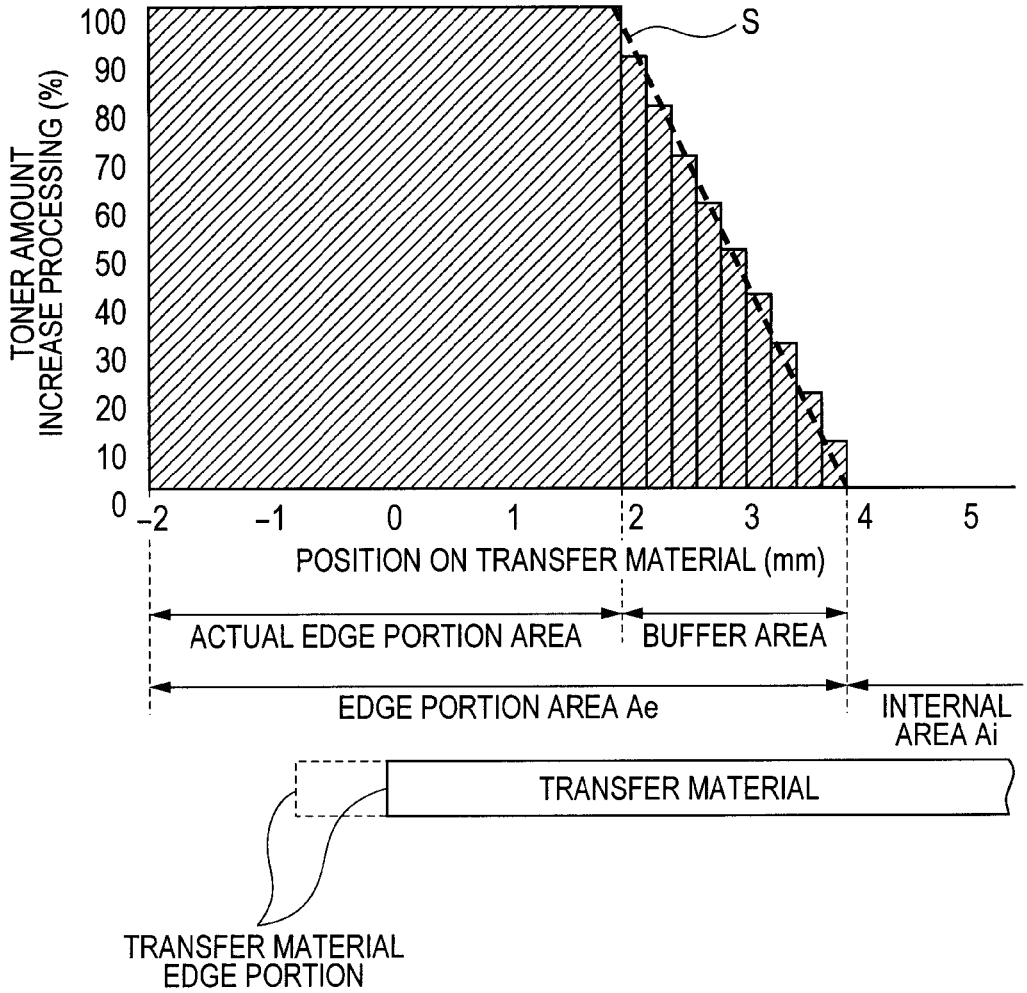
FIG. 11 illustrates an intensity relationship of the image processing in an edge portion area, which is performed in the image forming apparatus according to the first embodiment of the present invention.

Further, in this embodiment, the toner amount gradual increase processing is performed in Step S804, and thus a feeling of visual strangeness is prevented from occurring in the toner image after the above-mentioned toner amount increase processing. This processing is performed on the toner image in the above-mentioned buffer area. FIG. 11 schematically illustrates an enlarged edge portion of the transfer material and its vicinity with regard to the gradual increase processing performed in this embodiment. In this embodiment, as illustrated in FIG. 11, the buffer area which is 2 mm wide is divided into nine segments at regular intervals from the inner side to the outer side, and the intensity of the toner amount increase processing is increased in an order from the inner side.

Figure 12A:
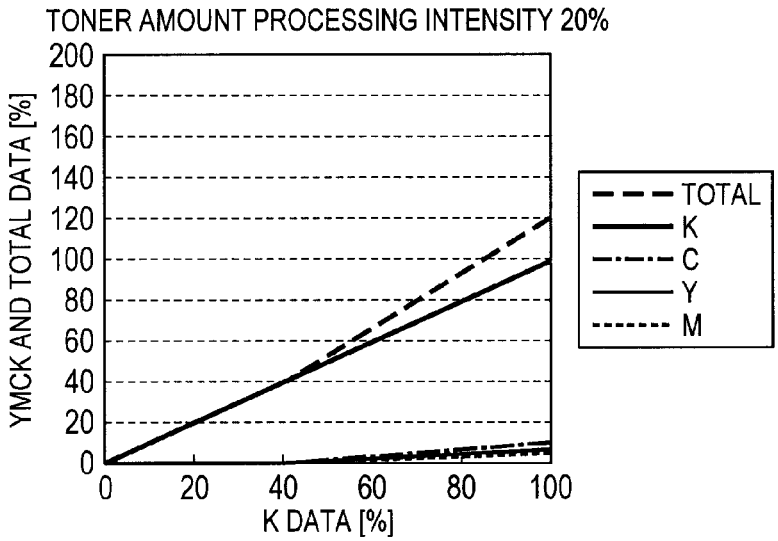
FIGS. 12A, 12B, and 12C illustrate an intensity relationship of the image processing performed in the image forming apparatus according to the first embodiment of the present invention.
Figure 12B:
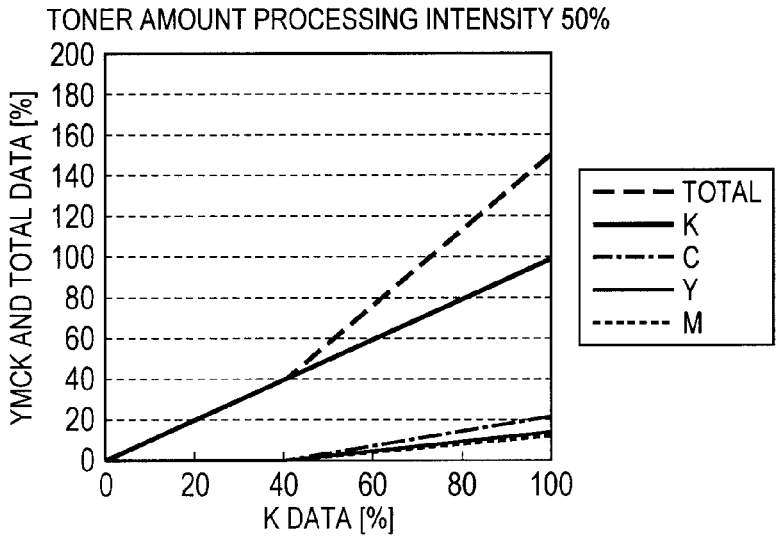
Figure 12C:
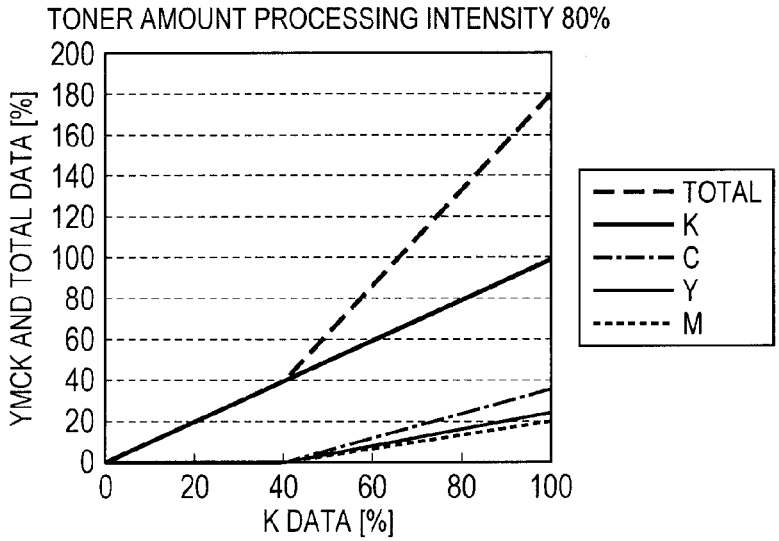

As illustrated in FIG. 10A, the toner amount increase processing of this embodiment is performed by adding the CMY toner image to the K data. Thus, the adjustment to the intensity of the toner amount increase processing, which is made in the toner amount gradual increase processing, means increase and decrease in CMY toner amount to be added to the same original K data. FIG. 12A illustrates a processing curve of a toner amount increase processing intensity of 20%, which indicates an increase of 20% corresponding to the increase in CMY toner amount illustrated in FIG. 10A, and indicates the second stage of the processing in the buffer area. Similarly, FIGS. 12B and 12C illustrate processing curves of toner amount increase processing intensities of 50% and 80%, which indicate the fifth and eighth stages of the processing in the buffer area, respectively.

Figure 10B:
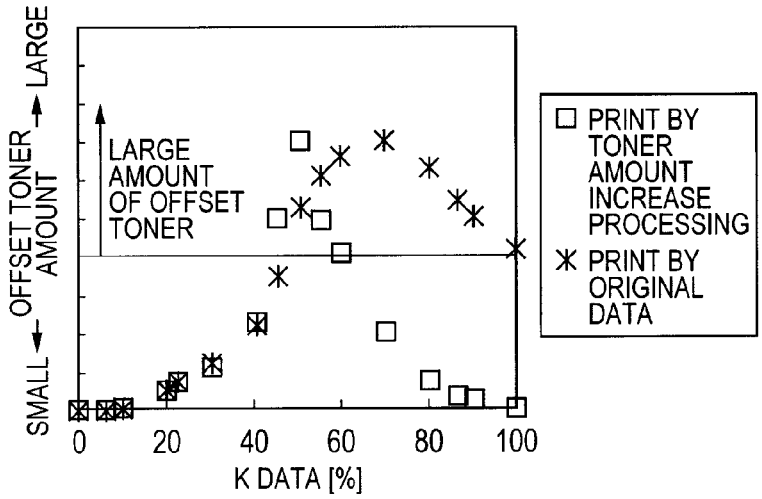
Figure 10C:
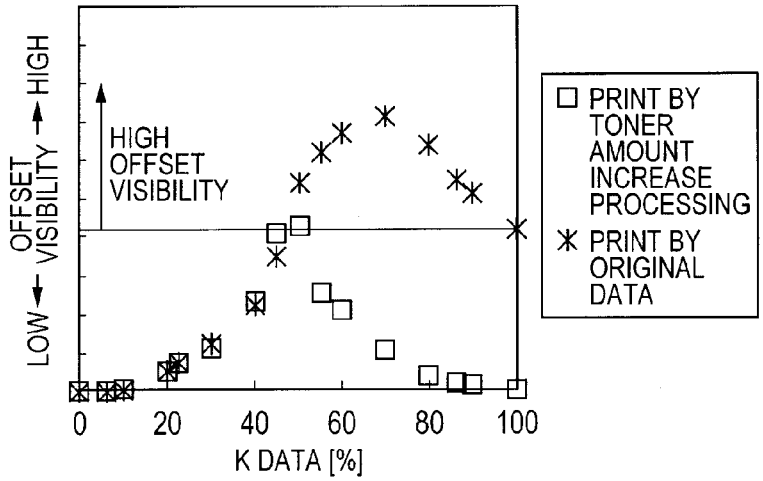

Referring to FIG. 10B, an effect of reducing an offset toner amount, which is provided by suppressing the excessive heating for fixing in the toner amount increase processing, is described. Referring to FIG. 10C, an effect of suppressing offset visibility due to decrease in fixing performance, which is provided through the toner amount increase processing, is described. As described above, in FIGS. 10A to 10C, the device YMCK data is assumed to be Y=M=C=0% and K=0% to 100%.

In the graph of FIG. 10B, the abscissa indicates a gradation of the K data, and the ordinate indicates an offset toner amount.

FIG. 10B illustrates at which gradation of the K data a peak of the offset toner amount comes when printing is executed based on K data contained in original image information before the toner amount increase processing and when printing is executed based on image information containing K data after the toner amount increase processing. In the case of printing based on the original K data, the offset toner amount is larger at a gradation of 50% to 100% (gradation width of Δ50%) of the K data. The offset toner amount is largest when the gradation of the K data is 70%. In other words, in the case of the single K color, the occurrence of the hot offset is most conspicuous at a toner amount when the gradation of the K data before the toner amount increase processing is 70%.

In the case of printing based on the K data after the toner amount increase processing, the offset toner amount is larger at a gradation of 45% to 60% (gradation width of Δ15%) of the original K data. The offset toner amount is largest when the gradation of the original K data is 50%. The total data amount (total toner amount) of the respective colors in this case is substantially equal to that in the case where the occurrence of the hot offset is most conspicuous before the toner amount increase processing.

In other words, through the toner amount increase processing, the gradation of the K data shifts to a lower side at the time of the total toner amount when the offset toner amount is largest (70%→50%). Thus, a ratio of the K data to the total toner amount is smaller based on a toner amount of a color of low visibility, and the hot offset occurs at the smaller ratio of the K data to the total toner amount. In other words, a hot offset amount of K, which is highest in visibility, is reduced. Further, it can be understood from FIG. 10B that the gradation width at which the offset toner amount is larger is reduced (Δ50%→Δ15%) and that the occurrence of the hot offset is suppressed at all the gradations.

In the graph of FIG. 10C, the abscissa indicates the same as that of FIG. 10B, and the ordinate indicates an offset visibility level. FIG. 10C illustrates comparison of offset visibility levels between when printing is executed based on the original K data and when printing is executed based on the K data after the toner amount increase processing. For the visibility level, various known image evaluation methods can be employed, and parameters of the ordinate vary from one method to another. Detailed description thereof is omitted herein.

In the case of printing based on the original K data, the offset visibility level is higher at a gradation of 50% to 100% of the K data corresponding to the offset toner amount. The offset visibility level is highest when the gradation of the K data is 70%.

In the case of printing based on the K data after the toner amount increase processing, the offset visibility level is higher at a gradation of 45% to 60% of the original K data corresponding to the offset toner amount. The offset visibility level is highest when the gradation of the original K data is 50%. However, a ratio of the K data to the total is smaller when the offset is large, and hence the visibility level is further suppressed as compared to the case of the printing based on the original K data. This is because toner increased by the toner amount increase processing is YMC toner.

In this case, the processing intensity in the buffer area is represented in divided nine stages, but alternatively, the processing may be performed by plotting the intensity along the broken line S of FIG. 11 without providing stages. The increase in number of stages may increase processing loads, but the feeling of visual strangeness can further be reduced instead. If the controller 103 is configured at low cost, it is preferred that the number of stages be reduced to avoid delay in the image formation time due to the increase in processing loads. Providing two to ten stages for the processing of the single K color group enables reduction in feeling of visual strangeness.

Specific Example 2 of Toner Amount Increase Processing

Figure 13:
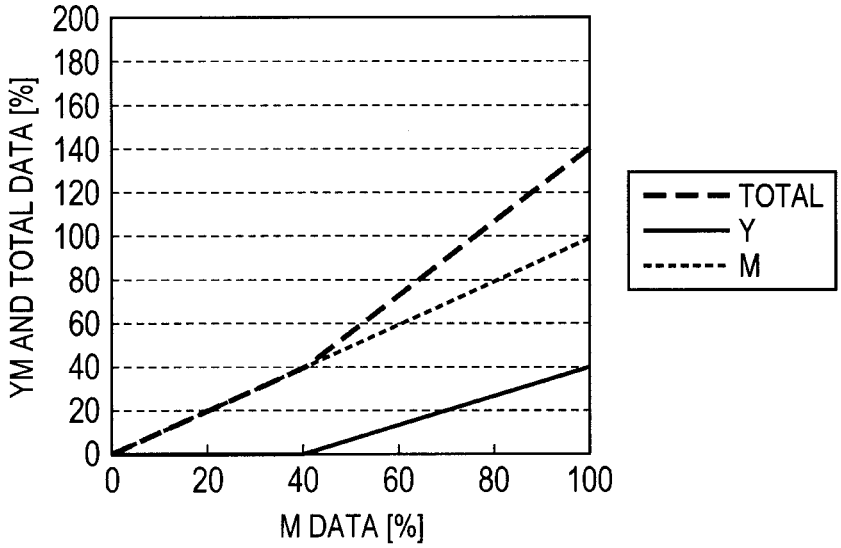
FIG. 13 illustrates another color conversion relationship of the image processing performed in the image forming apparatus according to the first embodiment of the present invention.

As another example, referring to a graph of FIG. 13, processing for a color belonging to a single M color group in which the device YMCK data determined in Step S802 is Y=C=K=0% and M=0% to 100% is described. In FIG. 13, executing the toner amount increase processing based on Y, which is relatively low in visibility, for a target color M conspicuous when the hot offset occurs provides the same effect of suppressing the offset toner amount as that of FIGS. 10A to 10C. Detailed description thereof is omitted herein.

In the graph of FIG. 13, the abscissa indicates a gradation of original M data determined in Step S802, and the ordinate indicates a gradation of YM data and total data of respective colors which are newly determined in Step S804.

When the original M data is 0% to 40%, the M data is maintained as it is. When the original M data is 40% to 100%, in other words, when a gradation of the original M data exceeds a threshold value, in addition to the original M data, Y data of about 0% to 40% is added. In this case, the total data is as shown in the graph.

Even in the case of the color belonging to the single M color group, when an image of a color M at a gradation of about 40% to 100% is present in the edge portion of the transfer material, image contamination due to the hot offset easily occurs (in the gradation of about 0% to 40% of the M data, the toner amount is small, and hence the offset toner amount is small even if the offset occurs and the image contamination is not conspicuous). The toner color is magenta, and hence the toner contamination of the transfer material when the offset occurs is still likely to be conspicuous though not as much as black.

Even for the image information of the color belonging to such a single color group, adding the Y data in the edge portion area and increasing the total data of the respective colors to perform printing enable suppression of occurrence of toner contamination of the transfer material P caused by the offset at any gradations.

This is because the total amount of toner for forming an image in the edge portion of the transfer material is increased to suppress occurrence of the hot offset, and the image contamination can be prevented from being conspicuous even if the offset occurs by using Y toner relatively lower in visibility on the transfer material P than M toner as toner to be increased.

In this processing, the Y toner that is relatively small in chromaticity change even when the Y toner is mixed with magenta is only added to the magenta color. Thus, chromaticity changes are suppressed to lower values as compared to the image color before the processing.

Further, in this embodiment, the toner amount gradual increase processing is performed in Step S804, and thus the feeling of visual strangeness is prevented from occurring in the toner image after the above-mentioned toner amount increase processing. In the toner amount gradual increase processing, similarly to Specific Example 1 described above, the toner image in the above-mentioned buffer area is divided into nine segments at regular intervals from the inner side to the outer side, and the intensity of the toner amount increase processing is increased in an order from the inner side.

Specific Example 3 of Toner Amount Increase Processing

Figure 14:
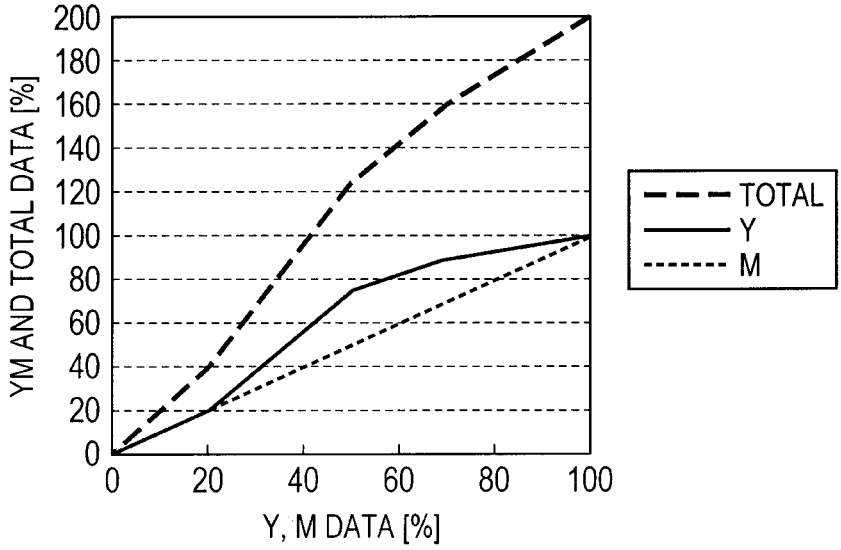
FIG. 14 illustrates still another color conversion relationship of the image processing performed in the image forming apparatus according to the first embodiment of the present invention.

As still another example, referring to a graph of FIG. 14, processing for a color belonging to a secondary Red color group in which the device YMCK data determined in Step S802 is C=K=0% and Y=M=0% to 100% is described. In FIG. 14, executing the toner amount increase processing based on Y, which is relatively low in visibility, for a target color M also provides the same effect of suppressing the offset toner amount as that of FIGS. 10A to 10C. Detailed description thereof is omitted herein.

In the graph of FIG. 14, the abscissa indicates a gradation of original Y data and original M data determined in Step S802, and the ordinate indicates a gradation of YM data and total data of respective colors which are newly determined in Step S804. When each of the original Y data and the original M data is 0% to 20%, the Y data and the M data are maintained as they are. When each of the original Y data and the original M data is 20% to 100%, in other words, when the gradation of the original Y data and the original M data exceeds a threshold value, Y data of about 0% to 25% is added while the original M data is maintained as it is. In this case, the total data of the respective colors is as shown in the graph.

Even in the case of the color belonging to the secondary Red color group, when an image of a color at a gradation of 20% or higher of the Y data and the M data is present in the edge portion of the transfer material, image contamination due to the hot offset easily occurs (in the gradation of 0% to 20% of the Y data and the M data, the toner amount is small, and hence the offset toner amount is small even if the offset occurs and the image contamination is not conspicuous). The toner color contains magenta toner, and hence the toner contamination of the transfer material when the offset occurs is still likely to be conspicuous.

Even for the image of such a color, adding the Y data in the edge portion area and increasing the total data of the respective colors to perform printing enable suppression of occurrence of toner contamination of the transfer material P caused by the offset at any gradations. This is because the total amount of toner for forming a toner image in the edge portion of the transfer material is increased to suppress occurrence of the hot offset, and the image contamination can be prevented from being conspicuous even if the offset occurs by using Y toner relatively lower in visibility on the transfer material P than M toner as toner to be increased.

In this processing, the Y toner that is relatively small in chromaticity change even when a mixing color amount in the Red color is increased is only added to the Red color. Thus, chromaticity changes are suppressed to lower values as compared to the image color before the processing.

Further, in this embodiment, the toner amount gradual increase processing is performed in Step S804, and thus the feeling of visual strangeness is prevented from occurring in the toner image after the above-mentioned toner amount increase processing. In the toner amount gradual increase processing, similarly to Specific Example 1 described above, the toner image in the above-mentioned buffer area is divided into four segments at regular intervals from the inner side to the outer side, and the intensity of the toner amount increase processing is increased in an order from the inner side. When the number of stages in the buffer area is large, the feeling of strangeness tends to be reduced, but as long as the processing is performed with small chromaticity changes as in this embodiment, visibility is still low even if the number of stages is reduced. The reduction in number of stages may contribute to reduction in number of steps necessary for the processing, which leads to high-speed processing.

Comparative Experiments

FIGS. 15A and 15B illustrate results of comparing print image levels between when the toner amount increase processing in Step S804 is executed and when the toner amount increase processing in Step S804 is not executed, during image formation carried out in the non-margin printing mode in the image forming apparatus of the first embodiment. The used image pattern was a pattern having images of representative colors #1 to #9 of the above-mentioned single K color group, single M color group, and secondary Red color group which were arranged in the edge portion area Ae of the transfer material P.

Experiment No. 1 was based on the configuration of this embodiment. Specifically, the toner amount increase processing in Step S804 was executed for the original image information determined in Step S802, and the total toner amount of respective colors was increased in the edge portion area to perform non-margin printing so that the intensity of the toner amount increase processing was gradually increased through the toner amount gradual increase processing.

In this case, a good print image having no toner contamination of the transfer material caused by the offset was obtained on the transfer material P. A chromaticity difference between the edge portion area Ae and the internal area Ai, which might be found due to the introduction of Step S804, was almost invisible, and degradation of the image was able to be suppressed.

Experiment No. 2 and Experiment No. 3 were based on configurations of comparison examples. Results of Experiment No. 2 were obtained in a case where the toner amount gradual increase processing in Step S804 was not executed and the toner amount increase processing was executed in the edge portion area Ae adjacent to the internal area Ai at the maximum toner amount increase processing intensity to perform the non-margin printing. Results of Experiment No. 3 were obtained in a case where the non-margin printing was performed without executing the toner amount increase processing in Step S804.

In Experiment No. 2, a good print image having no toner contamination of the transfer material caused by the offset over the colors #1 to #9 was obtained on the transfer material P. As to the colors #1 to #3, the chromaticity difference between the edge portion area Ae and the internal area Ai was slightly visible, but was at a tolerable level. As to the colors #4 to #9, recognition of the chromaticity difference between the edge portion area Ae and the internal area Ai fell within allowable criteria, and such a chromaticity difference was at an almost tolerable level. The almost invisible level of Experiment No. 1 is higher than the tolerable level and the almost tolerable level of Experiment No. 2.

In Experiment No. 3, as to the colors #1 to #3, toner contamination of the transfer material caused by the offset of the image positioned in the edge portion of the transfer material was recognized. As to the colors #4 to #9, slight contamination of the transfer material caused by the offset of the image was recognized. In contrast, the results of Experiment No. 1 based on this embodiment show that the occurrence of the offset is suppressed.

The results of Experiment No. 1 also show that the chromaticity change slightly occurring in Experiment No. 2 is lowered in visibility.

As described above, in the electrophotographic image forming apparatus of this embodiment that is capable of non-margin printing, fixing performance during the non-margin printing can be enhanced. In the toner amount increase processing, the toner amount of the color relatively lower in visibility as compared with the target color conspicuous when the offset occurs is increased. Thus, chromaticity changes accompanying the toner amount increase processing can be suppressed to smaller values. Further, as a result of the toner amount gradual increase processing, degradation of the image caused by a difference in color reproducibility between the edge portion area and the internal area is suppressed, and a good print image can be obtained in the entire area of the transfer material.

Second Embodiment

An image forming apparatus of the second embodiment is similar to the image forming apparatus of the first embodiment except for a color conversion relationship of Step S804 illustrated in FIGS. 16A to 20.

The image forming apparatus of this embodiment includes image forming sections of four colors, that is, yellow (Y), magenta (M), cyan (C), and black (K), a transfer device that includes an intermediate transfer belt as an intermediate transfer member, and a fixing device.

As described above, in the first embodiment, the toner amount increase processing for the image positioned in the edge portion area of the transfer material enables good suppression of the hot offset during the non-margin printing. However, to suppress toner contamination of the transfer material well even in a case of non-margin printing performed on not only plain paper but also such types of transfer materials as coat paper, glossy paper, and a glossy film, it is desired that the offset level be further reduced. Such a transfer material has high surface smoothness. Thus, offset toner transferred to a fixing film or a pressure roller easily adheres again to a surface of the transfer material, the toner is crushed on the transfer material to easily expand its area, and even a small amount of offset toner is conspicuous.

A configuration to achieve the object of the present invention is described below.

Specific Example 4 of Toner Amount Increase Processing

Figure 16A:
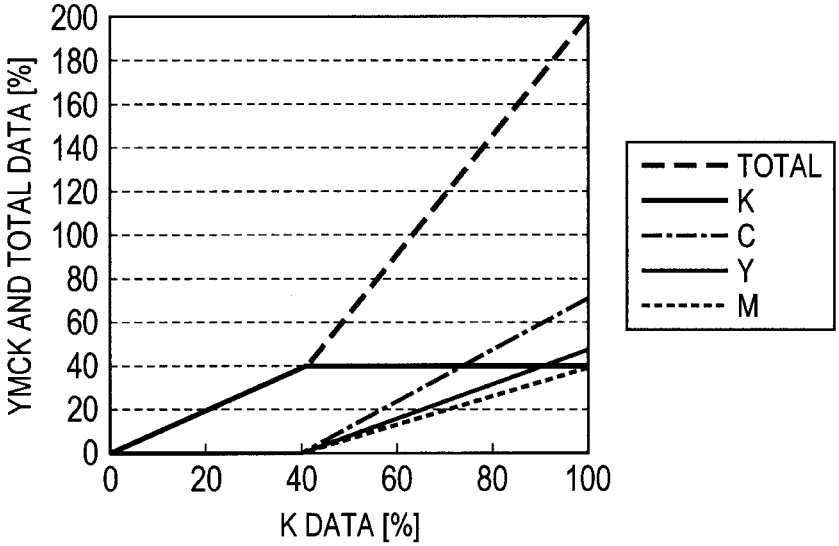
FIGS. 16A and 16B illustrate a color conversion relationship of image processing performed in an image forming apparatus according to a second embodiment of the present invention.

As an example of the toner amount increase processing in Step S804 of this embodiment, referring to a graph of FIG. 16A, processing for a color belonging to a single K color group in which device YMCK data determined in Step S802 is Y=M=C=0% and K=0% to 100% is described.

In the graph of FIG. 16A, the abscissa indicates a gradation of original K data determined in Step S802, and the ordinate indicates a gradation of the device YMCK data and total data of respective colors which are newly determined in Step S804.

When the gradation of the original K data is 0% to 40%, the gradation of the K data is maintained as it is. When the gradation of the original K data is 40% to 100%, in other words, when the gradation of the original K data exceeds a threshold value, the gradation of the K data is suppressed to 40% as a fixed value, and YMC data of respective colors of 0% to 72% are added. The gradation of the total data of the respective colors in this case is as indicated by a broken line of the graph. In the graph of FIG. 16A, the offset is prevented from being conspicuous by substituting toner of a color relatively low in visibility for toner of the target color in which an offset exceeding a threshold value easily occurs. This is similar for FIG. 17 that is referred to later.

Even in the case of the color belonging to the single K color group, when an image at a gradation of about 40% to 100% of the K data is present in the edge portion of the transfer material, image contamination due to the hot offset easily occurs (in the gradation of 0% to 40% of the K data, the toner amount is small, and hence the offset toner amount is small even if the offset occurs and the image contamination is not conspicuous). The toner color is black, and hence the toner contamination of the transfer material when the offset occurs is likely to be conspicuous.

Thus, in the case of the K data at the gradation of about 40% to 100%, the gradation of the K data is reduced, the YMC data is added instead, and the total data of the respective colors is increased to perform printing. As a result, at any gradations, the occurrence of toner contamination of the transfer material P caused by the offset can be greatly suppressed.

This is because the total amount of toner for forming an image in the edge portion of the transfer material is increased to suppress the hot offset, a ratio of K toner, which is high in visibility on the transfer material P, is reduced, and the image contamination is prevented from being conspicuous even if the offset occurs by using YMC toner relatively low in visibility instead. In this processing, the YMC toner that becomes a process black color when mixed together is only added to the black color. Thus, chromaticity changes are suppressed to a minimum as compared to the image color before the processing.

Figure 17:
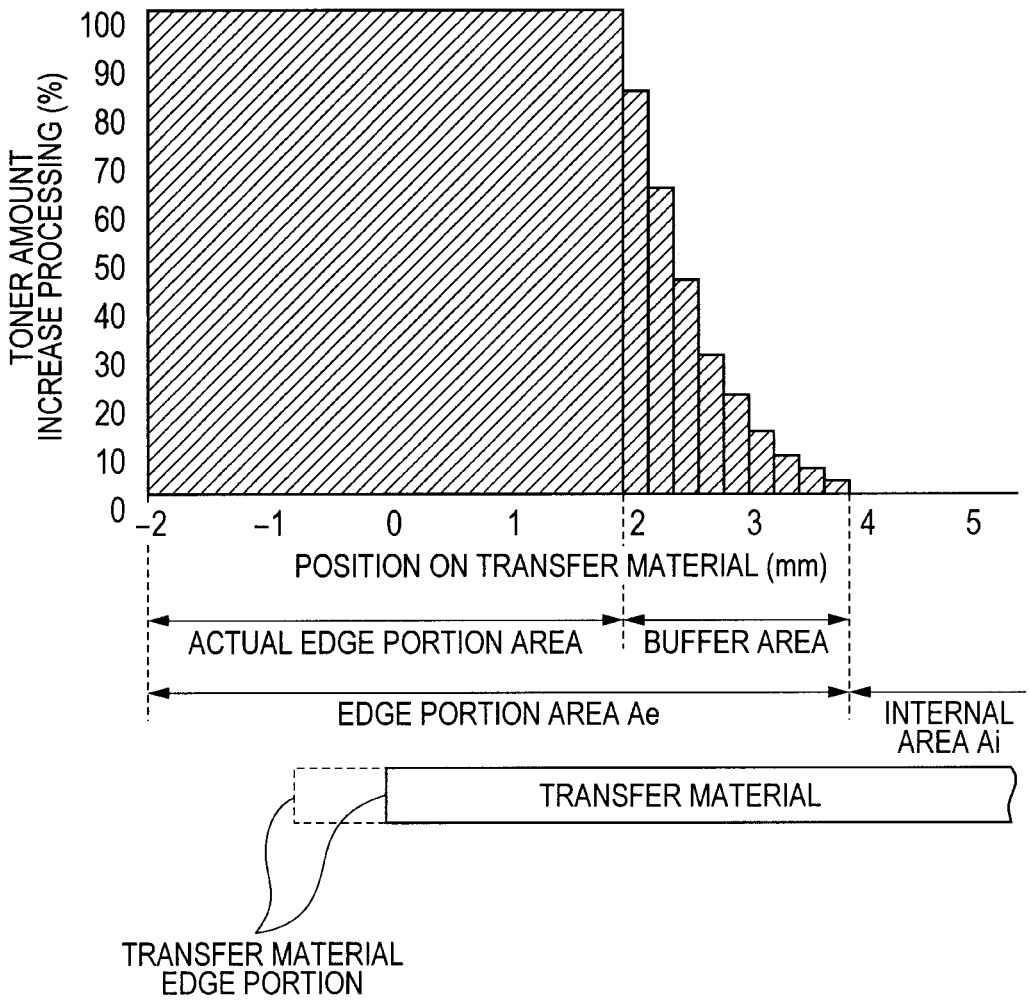
FIG. 17 illustrates an intensity relationship of the image processing in an edge portion area, which is performed in the image forming apparatus according to the second embodiment of the present invention.

Further, in this embodiment, the toner amount gradual increase processing is performed in Step S804, and thus a feeling of visual strangeness is prevented from occurring in the toner image after the above-mentioned toner amount increase processing. This processing is performed on the toner image in the above-mentioned buffer area. FIG. 17 schematically illustrates an enlarged edge portion of the transfer material and its vicinity with regard to the toner amount gradual increase processing performed in this embodiment. The buffer area is divided into nine segments at regular intervals from the inner side to the outer side, and the intensity of the toner amount increase processing is increased in an order from the inner side.

In the toner amount increase processing of this embodiment, as illustrated in FIG. 16A, the YMC toner is increased and the K toner is decreased at the same time. Now, the decrease in K toner in this case is briefly described. When K data having a certain gradation value equal to or higher than 40% is given, a difference of the gradation value from 40% is set as a value indicating an amount of the decrease in K toner. In general, when the K toner is decreased, the lightness of the color tends to be increased greatly. When the areas before and after the processing are adjacent to each other, the feeling of visual strangeness may be a problem. To address this problem, in this embodiment, as illustrated in FIG. 17, the change in intensity of the toner amount increase processing is represented as a curve, and the gradual increase processing is performed so that the toner amount increase processing is performed at lower intensity in the buffer area closer to the inner side thereof while the toner amount increase processing is performed at higher intensity in the buffer area closer to the outer side thereof. Through this processing, decrease in K toner is restricted in the vicinity of the internal area Ai to reduce a lightness change, thereby performing the toner amount increase processing while blurring the boundary portion.

Figure 18A:
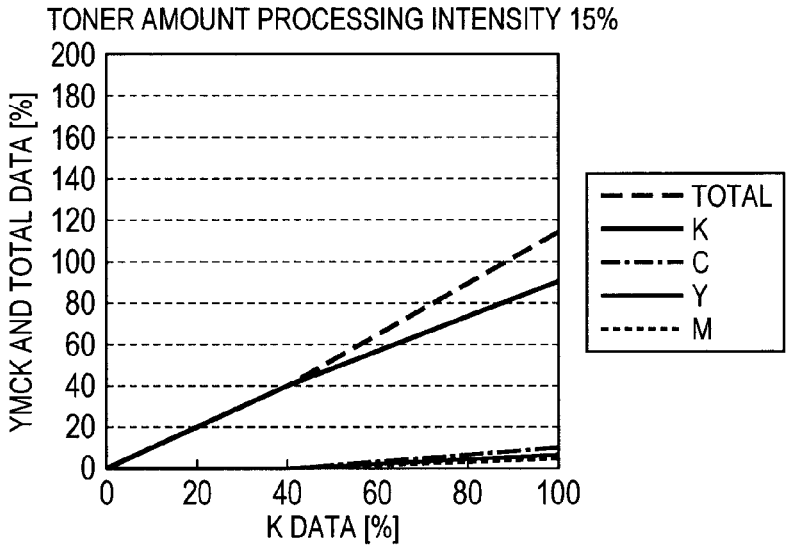
FIGS. 18A, 18B, and 18C illustrate an intensity relationship of the image processing performed in the image forming apparatus according to the second embodiment of the present invention.
Figure 18B:
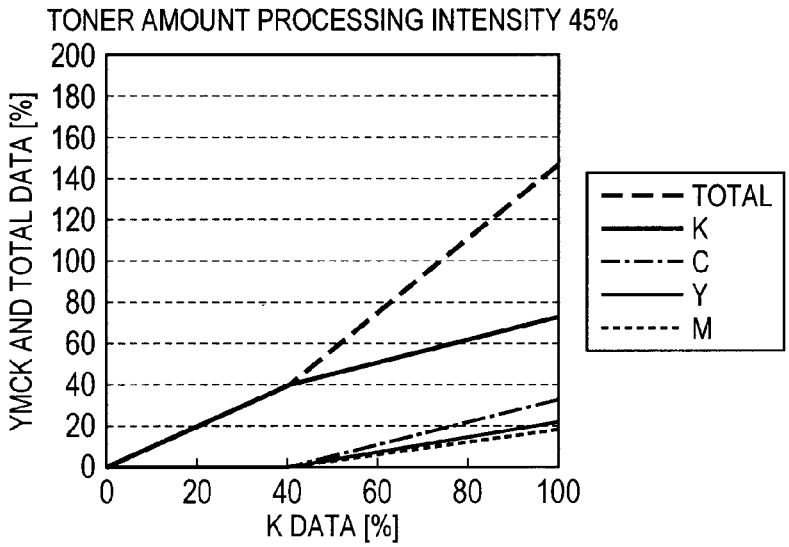
Figure 18C:
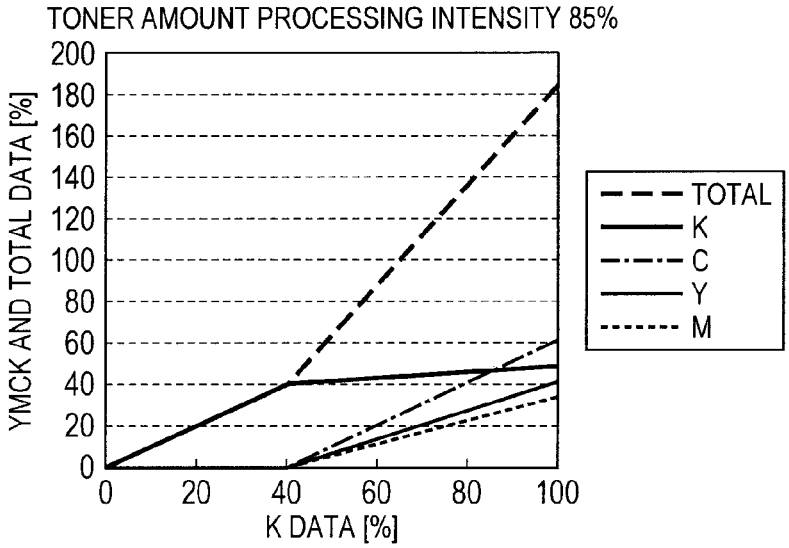

In the respective stages of the toner amount increase processing of FIG. 17, the processing is performed on, for example, the original K data as illustrated in FIGS. 18A to 18C. FIG. 18A illustrates a processing curve of a toner amount increase processing intensity of 15%, which indicates an increase of 15% corresponding to the increase in CMY toner amount illustrated in FIG. 16A, and indicates the fourth stage of the processing in the buffer area. Similarly, FIGS. 18B and 18C illustrate processing curves of toner amount increase processing intensities of 45% and 85%, which indicate the seventh and ninth stages of the processing in the buffer area, respectively.

An effect of suppressing the offset toner amount, which is provided by the toner amount increase processing of this embodiment, is basically similar to that described above referring to FIGS. 10A to 10C. However, in the case of FIG.

Figure 16B:
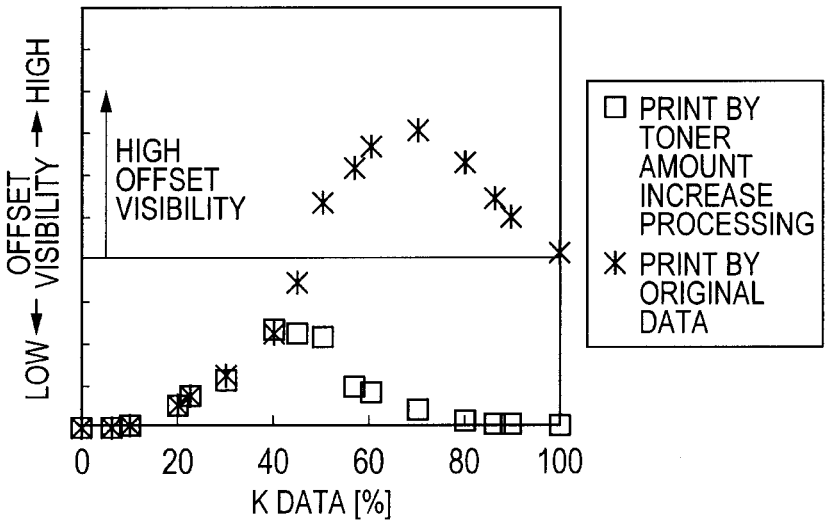

16A, when the gradation of the K data is set equal to or higher than the threshold value, the toner amount increase processing is carried out by substituting toner of a color (CMY mixing color) relatively low in visibility for toner of the target color (K). Thus, when the K data takes a gradation equal to or higher than a certain threshold value, the toner amount corresponding to the K data is smaller than that of FIGS. 10A to 10C, and hence an image formed object with the further reduced offset can be obtained. FIG. 16B illustrates its result.

In the graph of FIG. 16B, the abscissa indicates a gradation of the K data, and the ordinate indicates an offset visibility level. An image evaluation method, the ordinate, and parameters of the ordinate are similar to those of FIGS. 10A to 10C. In FIG. 16B, offset visibility levels are compared with each other between when printing is executed based on the K data before the toner amount increase processing and when printing is executed based on the K data after the toner amount increase processing.

In the case of printing based on the original K data, the offset visibility level is higher at a gradation of 50% to 100% of the K data corresponding to the offset toner amount. The offset visibility level is highest when the gradation of the K data is 70%.

In the case of printing based on the K data after the toner amount increase processing, the offset visibility level is higher at a gradation of 45% to 60% of the original K data corresponding to the offset toner amount. The offset visibility level is highest when the gradation of the original K data is 50%. However, the visibility level is further suppressed as compared to the case of the printing based on the original K data. The suppression effect of this embodiment is greater than that of the first embodiment described referring to FIG. 10C. This is because not only the YMC toner is increased but also the K toner is decreased through the toner amount increase processing.

Specific Example 5 of Toner Amount Increase Processing

Figure 19A:
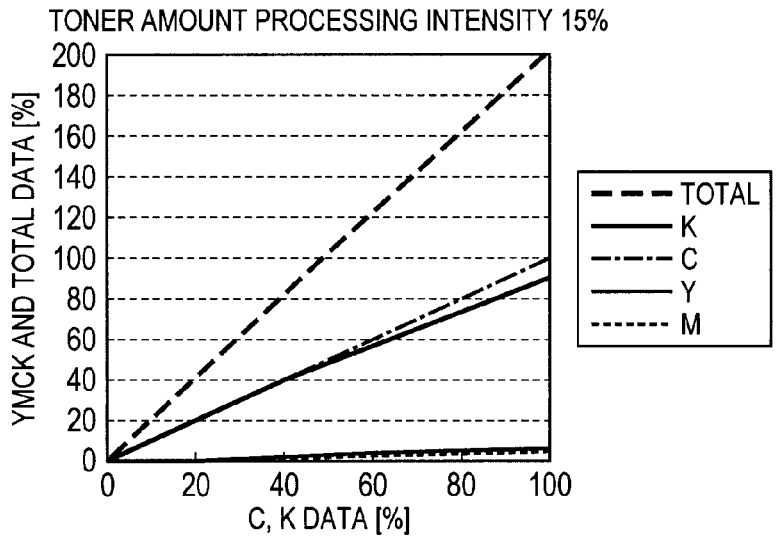
FIGS. 19A, 19B, and 19C illustrate another color conversion relationship of the image processing performed in the image forming apparatus according to the second embodiment of the present invention.
Figure 19B:
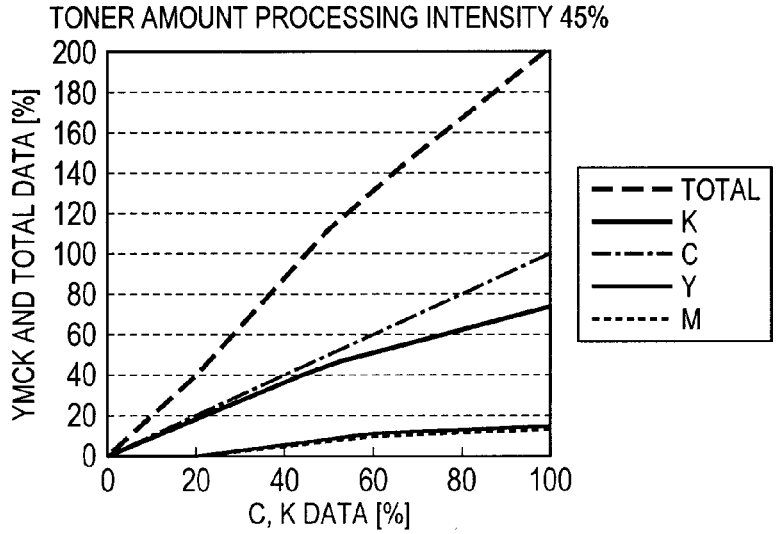
Figure 19C:
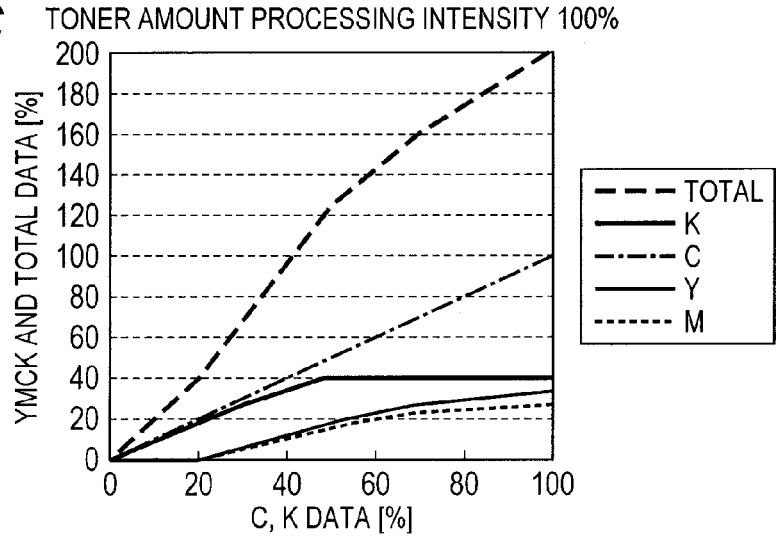

As another example, referring to a graph of FIG. 19C, processing for a color belonging to a mixing color group of C and K (bluish black) in which the device YMCK data determined in Step S802 is Y=M=0% and C=K=100% is described. In FIG. 19C, executing the toner amount increase processing based on CMY mixing color, which is relatively low in visibility, for a target color K also provides the same effect of suppressing the offset toner amount as that of FIGS. 16A and 16B. Detailed description thereof is omitted herein.

In the graph of FIG. 19C, the abscissa indicates a gradation of original C data and original K data determined in Step S802, and the ordinate indicates a gradation of the device YMCK data and total data of respective colors which are newly determined in Step S804.

When each of the original C data and the original K data is 0% to 20%, the C data and the K data are maintained as they are. When each of the original C data and the original K data is 20% to 100%, in other words, when the gradation of the original C data and the original K data exceeds a threshold value, the K data is suppressed to 40% or lower while the C data is maintained as it is, and YM data of respective colors of about 0% to 33% are added. In this case, the total data of the respective colors is as indicated by a broken line of the graph.

Even in the case of the color belonging to the mixing color group of C and K, when an image of a color at a gradation of 20% or higher of the C data and the K data is present in the edge portion of the transfer material, image contamination due to the hot offset easily occurs (in the gradation of 0% to 20% of the C data and the K data, the toner amount is small, and hence the offset toner amount is small even if the offset occurs and the image contamination is not conspicuous). The toner color contains black toner, and hence the toner contamination of the transfer material when the offset occurs is still likely to be conspicuous.

Even for such a color, the K data is decreased and the YM data are added in the edge portion area, and a gradation value of the total data of the respective colors is increased to perform printing, with the result that the occurrence of toner contamination of the transfer material P caused by the offset can be suppressed at any gradations. This is because the total amount of toner for forming an image in the edge portion of the transfer material is increased to suppress the occurrence of the hot offset, K toner, which is high in visibility on the transfer material P, is decreased, and the image contamination can be prevented from being conspicuous if the offset occurs by using YM toner relatively low in visibility instead. In this processing, the YM toner that is relatively small in chromaticity changes when mixed is only added to the color in the mixing color group of C and K. Thus, chromaticity changes are suppressed to lower values as compared to the image color before the processing.

Further, in this embodiment, the toner amount gradual increase processing is performed in Step S804, and thus the feeling of visual strangeness is prevented from occurring in the toner image after the above-mentioned toner amount increase processing. Similarly to the measures in Specific Example 4 described above, this processing is performed on the toner image in the above-mentioned buffer area.

Also in the toner amount increase processing of this embodiment, as illustrated in FIG. 19C, the YMC toner is increased and the K toner is decreased at the same time. Thus, similarly to Specific Example 4, to reduce the feeling of visual strangeness occurring when the areas before and after the processing are adjacent to each other, as illustrated in FIG. 17, the change in intensity of the toner amount increase processing is represented as a curve, and the gradual increase processing is performed so that the toner amount increase processing is performed at lower intensity in the buffer area closer to the inner side thereof while the toner amount increase processing is performed at higher intensity in the buffer area closer to the outer side thereof. Through this processing, decrease in K toner is restricted in the vicinity of the internal area Ai to reduce a lightness change, thereby performing the toner amount increase processing while blurring the boundary portion.

In the respective stages of the toner amount increase processing of FIG. 17, the processing is performed on, for example, the original C data and the original K data as illustrated in FIGS. 19A and 19B. FIG. 19A illustrates a processing curve of a toner amount increase processing intensity of 15%, which indicates an increase of 15% corresponding to the increase in CMY toner amount illustrated in FIG. 19C and a decrease of K corresponding to 15%, and also indicates the fourth stage of the processing in the buffer area from the inner side. Similarly, FIG. 19B illustrates a processing curve of a toner amount increase processing intensity of 45%, which indicates the seventh stage of the processing in the buffer area from the inner side.

As described above, in the electrophotographic image forming apparatus of this embodiment that is capable of non-margin printing, fixing performance during the non-margin printing can be enhanced. As illustrated in FIGS. 16A and 16B and FIG. 17, a ratio of black that is the target color when the offset occurs can be set lower than that of the first embodiment, and hence the offset can be prevented from being conspicuous more greatly.

Thus, even in a case of non-margin printing executed by using not only plain paper but also such transfer materials of high surface smoothness as coat paper, glossy paper, and a glossy film, a print image can be obtained in which toner contamination of the transfer material caused by the offset of an image transferred to the edge portion of the transfer material in the fixing device is suppressed.

In the second embodiment, as illustrated in FIGS. 16A, 16B, 19A, 19B, and 19C, a toner consumption amount is larger than that of the first embodiment. Thus, the first embodiment may be implemented in the case of plain paper or a printing mode corresponding to plain paper. The second embodiment may be implemented in the case where a transfer material of high surface smoothness such as coat paper, glossy paper, or a glossy film is used or in a case of a printing mode corresponding thereto. This way, the offset status can be efficiently reduced, the toner consumption amount can be further reduced, and usability can be further improved.

Third Embodiment

Figure 22A:
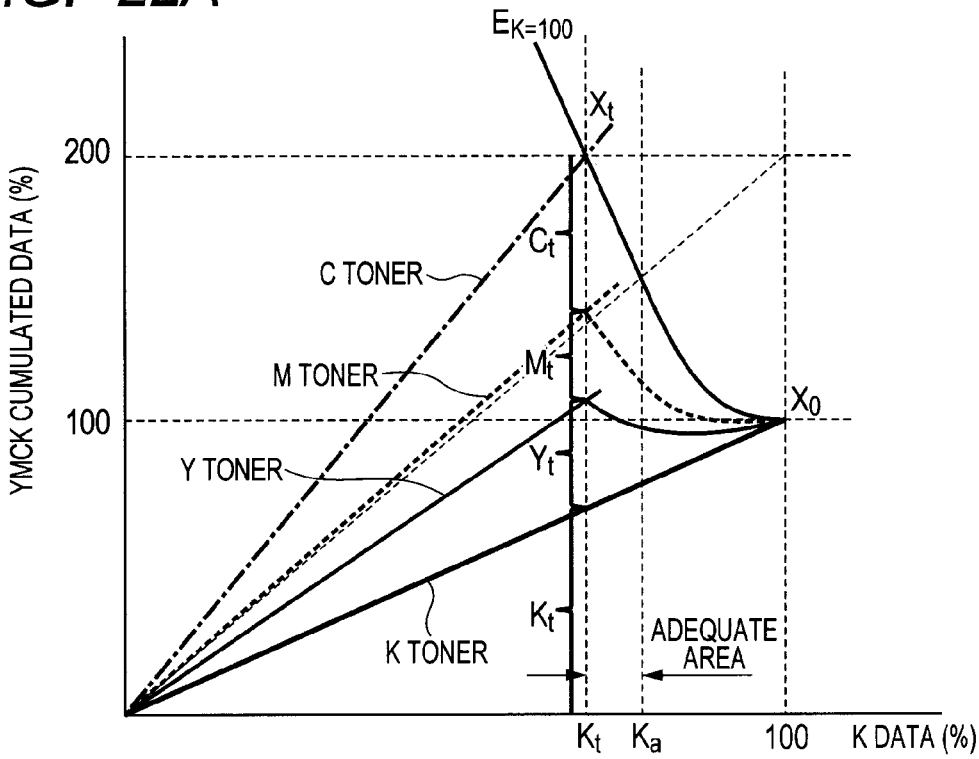
FIGS. 22A and 22B illustrate image processing areas in the image forming apparatus according to the third embodiment of the present invention.
Figure 22B:
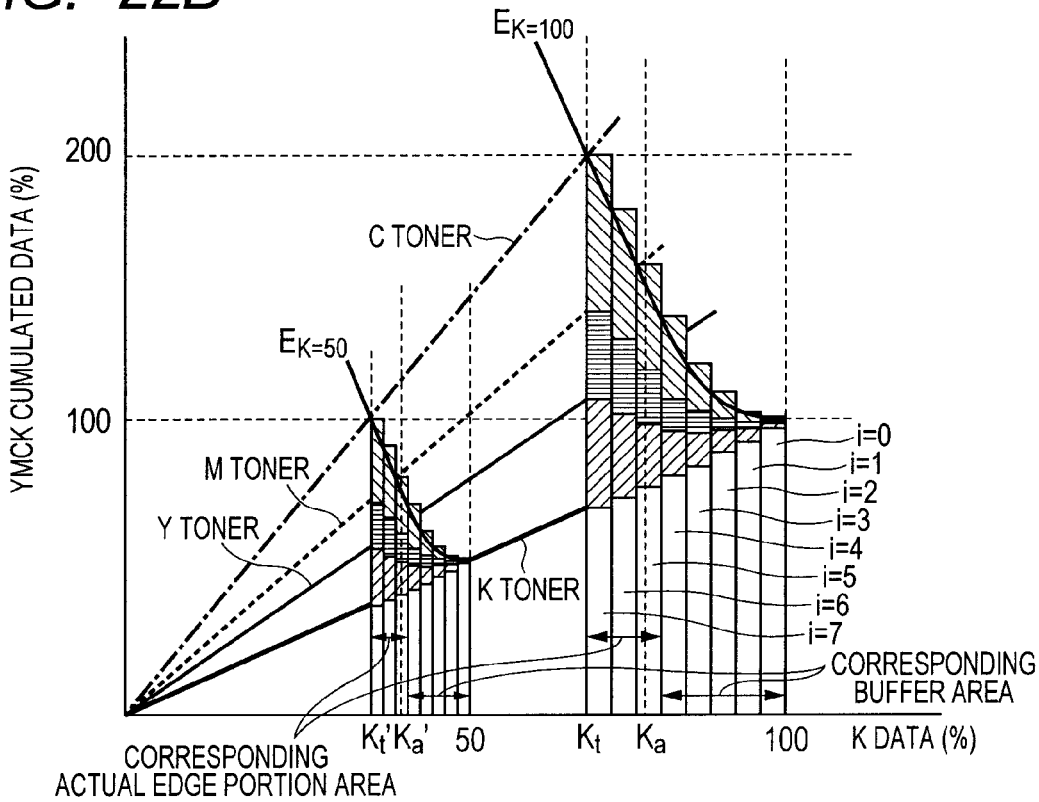

An image forming apparatus of the third embodiment is similar to the image forming apparatus of the second embodiment except for a color conversion relationship of Step S804 illustrated in FIGS. 22A and 22B.

The image forming apparatus of this embodiment includes image forming sections of four colors, that is, yellow (Y), magenta (M), cyan (C), and black (K), a transfer device that includes an intermediate transfer belt as an intermediate transfer member, and a fixing device.

As described above, in the first and second embodiments, the toner amount increase processing for the image positioned in the edge portion area of the transfer material enables good suppression of the hot offset during the non-margin printing. Described in this embodiment is an arrangement for further reducing the feeling of visual strangeness due to the chromaticity changes occurring when the toner amount increase processing is performed.

The target color of this embodiment is K. By decreasing the amount of use of K toner and substituting YMC toner for the K toner, the hot offset of K is reduced and the hot offset in the edge portion of the transfer material illustrated in FIG. 5 is reduced. The above-mentioned conditions (1) and (2) of the first embodiment are relaxed for the YMC toner and a complex color, and hence in this embodiment, the toner amount increase processing and the toner amount gradual increase processing are not performed.

In this embodiment, the processing in Step S804 to be performed on the K data is determined under the following conditions.

(3) Total Amount of YMC Data with Respect to K Data

Figure 20:
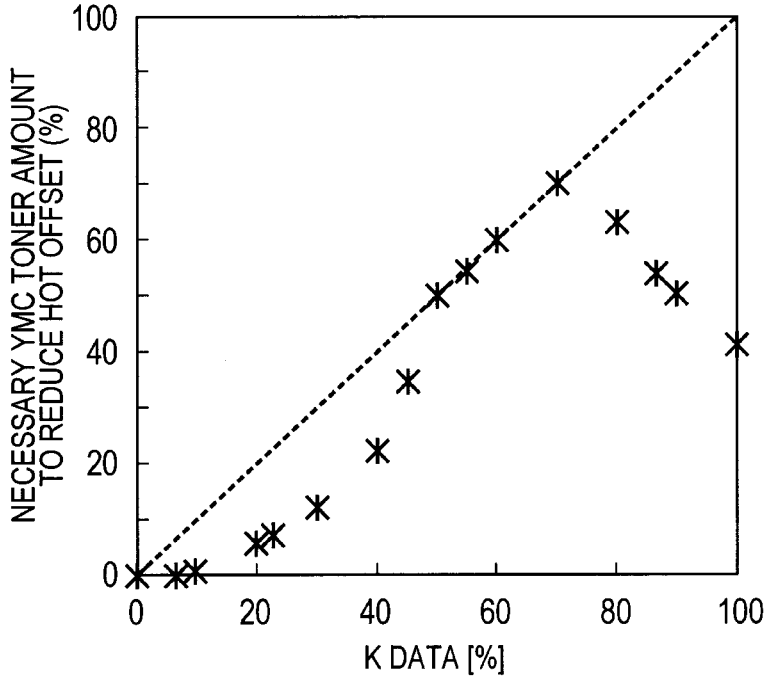
FIG. 20 illustrates an image processing relationship regarding a hot offset in an image forming apparatus according to a third embodiment of the present invention.

FIG. 20 is a graph showing results of examining a data amount of the YMC toner necessary to reduce the hot offset by superimposing the YMC toner (colors in equal proportions) on the K toner, the results being obtained with respect to a data amount of the K toner. This curve is possibly unique to the image forming apparatus, but also in other apparatus, the necessary YMC toner amount may be obtained through the same experiment. It is found in this embodiment that the hot offset of all the K data can be reduced by superimposing YMC toner in an amount of the K toner or more.

(4) Maximum Amount of Total Toner Data

When the total toner amount is excessively large after the YMC toner is superimposed, fixing failure may occur because of lack of the amount of heat. In this embodiment, a case where the maximum data amount of toner is limited to 200% is described. The maximum data amount of toner may be determined based on printing speed of the apparatus, characteristics of toner, and the configuration of the fixing device. Even if the set limit of the maximum data amount of toner is not 200%, the same effect may be obtained through the measures taken in this embodiment.

(5) Data Ratio of YMC Toner

Figure 21:
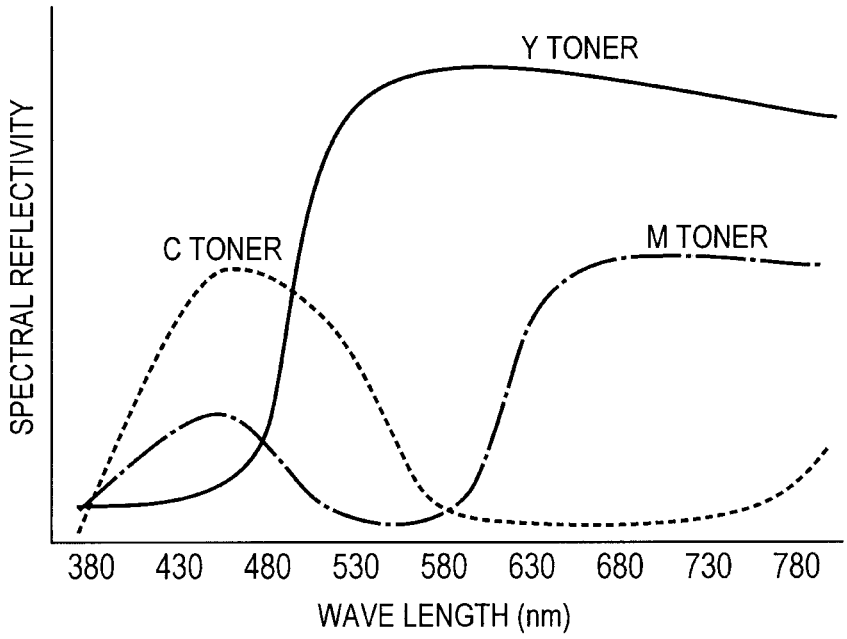
FIG. 21 illustrates toner spectral reflection characteristics in the image forming apparatus according to the third embodiment of the present invention.

In this embodiment, when the CMY toner is substituted for K, conversion is further performed so as to reduce a color difference (expressed as a distance dE between different colors in the color space), which is a difference in chromaticity (for example, coordinates of the respective colors in the L*a*b* color space). FIG. 21 illustrates toner spectral reflection characteristics. A reflection characteristic obtained when colors of toner are mixed together corresponds to a product of reflectivity values of the respective colors, and hence when all the colors of the YMC toner are mixed together, the reflectivity is lowered in the entire visible region, resulting in an achromatic color group. Selecting the mixing ratio of colors based on the spectral reflection characteristics of FIG. 21 may result in a color approximating to the achromatic color. In this embodiment, the achromatic color is obtained by setting Y:M:C to 35:25:40. The lightness (L*) may further be lowered by increasing the used toner amount. Thus, the achromatic color between black and white can be reproduced by increasing and decreasing the toner amount while maintaining the above-mentioned mixing ratio.

FIG. 22A illustrates a conversion curve to be used in Step S804, which is performed under the above-mentioned conditions (3) to (5) on a toner image in which the K toner data is 100%. A curve $E_{K=100}$ is a toner mixing curve for obtaining the same chromaticity as that of the toner image (black) in which the K toner data is 100%. Therefore, when the amount of the K toner is decreased in a color $X_0$, in which the data amount of the K toner is 100%, and the resultant value is defined as $K_t$, the YMC toner is added in amounts of $Y_t$, $M_t$, and $C_t$ ($Y_t$:$M_t$:$C_t$=35:25:40) to compensate for the decreased K toner, and a converted color $X_t$ is obtained. As a result, the same chromaticity (lightness) is maintained. $K_a$ represents K data obtained when the K data and the YMC data are equal to each other on the curve $E_{K=100}$, and $K_t$ represents K data obtained when the sum of the K data and the YMC data is 200% on the curve $E_{K=100}$. Thus, by performing conversion to obtain the YMCK toner data that is indicated on the curve $E_{K=100}$ in a range between $K_t$ and $K_a$, the processing causes no chromaticity changes, no hot offset, and no fixing failure.

In this embodiment, an isochromatic curve like the curve $E_{K=100}$ is used for performing the toner amount increase processing and the toner amount gradual increase processing in Step S804. FIG. 22B illustrates specific processing performed on toner images in the edge portion area Ae, which are formed of 100% K data (black) and 50% K data (gray), respectively. The stepwise bar graphs of FIG. 22B show details of the intensity of the toner amount increase processing. To represent toner amounts of the respective isochromatic curves, the areas are divided into eight segments each in ranges of 100% to 200% and 50% to 100% of the total data, and the intensity of the toner amount increase processing is represented in stages of i=0 to 7. In this embodiment, the intensity stages of the toner amount increase processing as illustrated in FIG. 22B are generated for the K data of 0% to 100%, and used for the processing in Step S804.

As described in the first embodiment, the actual edge portion area is an area in which the edge portion of the transfer material may be positioned. In the actual edge portion area, it is preferred that the toner amount increase processing be performed at the intensities of i=5 to 7 in the range between $K_t$ and $K_a$ in which the hot offset and the fixing failure can be prevented. In this embodiment, the toner amount increase processing is performed at the intensity of i=7.

Further, in this embodiment, chromaticity changes caused by the toner amount increase processing are suppressed owing to the above-mentioned condition (5). However, because the developing condition and the transfer condition of each toner vary depending on ambient temperature and humidity and a status of use, chromaticity changes may still occur when the YMC data amount is processed at a fixed ratio.

In this embodiment, chromaticity changes caused by the toner amount increase processing are further reduced through the gradual increase processing in which the toner amount is gradually increased in the stages of i=0 to 7 defined in the buffer area.

Through the above-mentioned toner amount increase processing and toner amount gradual increase processing, in the electrophotographic image forming apparatus of this embodiment that is capable of non-margin printing, the hot offset can be reduced and the fixing performance can be enhanced during the non-margin printing. Further, the feeling of visual strangeness can be reduced by reducing the chromaticity changes between the edge portion area Ae and the internal area Ai.

In this embodiment, the toner amount increase processing is performed at the intensity of i=7 in the actual edge portion area, but alternatively, the toner amount increase processing may be performed at the intensity of i=5, with the result that the total toner amount for the edge portion area can be suppressed and the occurrence of the hot offset can thus be prevented.

Fourth Embodiment

In each of the above-mentioned embodiments, the area for performing the toner amount increase processing covers all the leading, trailing, left, and right edge portions (FIG. 8B) constituting the edge portion area of the transfer material P. However, according to characteristics of the image forming apparatus, the portion to be processed may be limited to a portion where the offset easily occurs.

For example, there is provided an image forming apparatus configured such that a pre-rotation operation of a fixing device is started simultaneously with starting of an image forming operation, and waste heat is accumulated in a fixing film or a pressure roller of the fixing device before a transfer material reaches a fixing nip. In such an image forming apparatus, the offset tends to occur more easily in the leading edge portion of the transfer material P than in the trailing, left, and right edge portions. When the leading edge portion of the transfer material P enters the fixing device to start a fixing process, the waste heat is gradually removed from the fixing device. Thus, the offset is relatively less likely to occur in the trailing, left, and right edge portions of the transfer material P. In this image forming apparatus, the toner amount increase processing needs to be performed only for the leading edge portion. The toner amount increase processing may be performed for toner images corresponding to not only the leading edge portion but also at least one of the leading, trailing, right, and left edge portions where the offset easily occurs.

The image forming apparatus described in each of the embodiments uses a "film fixing method" employing a fixing film as the fixing device. Used for the fixing film is, for example, a film member having a diameter of 24 mm formed by coating a surface of a polyimide resin having a thickness of 50 μm with a fluororesin having a thickness of 10 μm. A ceramic heater is disposed in the fixing film, and the fixing film abuts an opposingly disposed pressure roller at pressure of about 200 to 400 N. Used for the pressure roller is, for example, a roller member having a diameter of 25 mm formed by depositing a silicon rubber layer having a thickness of 3 mm on an outer periphery of a core metal and coating its surface with a fluororesin layer having a thickness of 15 μm.

There is an image forming apparatus that includes a fixing device of a "roller fixing method" employing a fixing roller in place of a fixing film. Used for the fixing roller is, for example, a roller member formed by depositing a silicon rubber layer having a thickness of 2 mm on a core metal of an iron having an outer diameter of 46 mm and a thickness of 2 mm, and coating its surface with a fluororesin having a thickness of 20 μm. A halogen heater is disposed in the fixing roller, and the fixing roller abuts an opposingly disposed pressure roller at pressure of about 500 to 800 N. The same roller member as above is used for the pressure roller.

In general, the fixing device of the "film fixing method" is characterized by its capability of performing an on-demand fixing operation by short-time temperature rising, and the fixing device of the "roller fixing method" is characterized by its capability of obtaining high glossiness on a print image sample by the high abutment pressure.

Needless to say, the toner amount increase processing described above is useful in an image forming apparatus that includes a fixing device of any method including the above-mentioned two methods. However, this processing is more advantageous in an image forming apparatus that includes a fixing device of the "film fixing method". The reason is as follows.

In the fixing device of the "roller fixing method", as described above, abutment pressure in the fixing nip portion is higher than that in the fixing device of the "film fixing method". Accordingly, in addition to the offset (hot offset) caused by a thermal factor described above in the first embodiment of the present invention, an offset (mechanical offset) caused by a pressure factor occurs. The offset caused by the pressure factor is a phenomenon in which, due to application of high pressure in the fixing nip, a part of toner on the transfer material does not stay on the surface of the transfer material but is physically separated from the transfer material to move onto the fixing roller. On the other hand, in the fixing device of the "film fixing method", abutment pressure is low, and the offset mainly occurs due to a thermal factor. Thus, the toner amount increase processing of the present invention provides a higher effect.

Fifth Embodiment

In each of the above-mentioned embodiments, the image forming apparatus 100 performs the toner amount increase processing. However, this arrangement is in no way limitative. The host computer 101 connected to the image forming apparatus may perform the toner amount increase processing of the image forming apparatus 100. In this way, the configuration of the image forming apparatus 100 can be further simplified, enabling cost reduction.

More specifically, the host computer 101 includes a printer driver that converts image data generated by an arbitrary application into image information to be interpreted by the image forming apparatus 100. The printer driver generates image information of YMCK subjected to the toner amount increase processing in Step S804 by using the image data generated by the arbitrary application as input image data in Step S800.

The printer driver further performs control so as to compress data of the generated image information, and output the compressed data to a port of the host computer 101 whose destination has been set to the image forming apparatus 100 in advance. The host computer 101 transmits and outputs to the image forming apparatus 100 the compressed data that has been output to the port according to the port setting.

The controller 103 receives the compressed image data transmitted from the host computer 101, decompresses the data, and outputs the decompressed data of image information to a printer engine side or the printer engine control unit 104. The printer engine side refers to the printer engine control unit 104 and the printer engine described referring to FIG. 2.

As described above, according to the fifth embodiment, performing image processing as the toner amount increase processing by the host computer 101 enables simplification of the configuration of the image forming apparatus 100. As a result, even when an image is formed by the cost-reduced image forming apparatus, effects similar to those of the above-mentioned first to fourth embodiments can be obtained.

Sixth Embodiment

In each of the above-mentioned embodiments, the toner amount increase processing is carried out by increasing a toner amount of a color (for example, CMY mixing color) relatively lower in visibility compared to a target color image (for example, K image information) of the toner amount increase.

However, in the electrophotographic image forming apparatus capable of performing non-margin printing, the above-mentioned arrangement is in no way limitative for enhancing fixing performance during the non-margin printing. In the edge portion area, for example, for a K color, the toner amount increase processing may be carried out by using the same K color. In this case, in the edge portion area, chromaticity changes are slightly larger than those in the first to fifth embodiments. However, this arrangement can avoid a total toner amount that causes the offset to easily occur, providing an effect of enhancing fixing performance.

Other Embodiments

Various embodiments have been described above in detail. However, the present invention may be applied to a system that includes multiple devices or an apparatus that includes one device. For example, the present invention may be applied to a computer system that includes a printer, a facsimile, a PC, a server, and a client.

The present invention can be achieved by supplying software programs for realizing the functions of the embodiments described above to the system or the apparatus directly or from a remote place, and reading the supplied program codes by a computer included in the system to execute the programs.

Thus, the program codes installed in the computer to realize the functions and processing of the present invention by the computer also realize the present invention. In other words, the computer programs to realize the above-mentioned functions and processing are also one of the components of the present invention.

In this case, as long as program functions are provided, any types of programs such as object codes, programs executed by an interpreter, and script data supplied to the OS may be employed.

As recording media for supplying the programs, a flexible disk, a hard disk, an optical disk, a magneto-optical disk, an MO, a CD-ROM, a CD-R, and a CD-RW may be employed, for example. Other recording media may be a magnetic tape, a nonvolatile memory card, a ROM, and a DVD (DVD-ROM or DVD-R).

The program may be downloaded from a home page of the Internet by using a browser of a client computer. In other words, the computer program of the present invention or a compressed file including an automatic installation function may be downloaded from the home page onto a recording medium such as a hard disk. The functions can be realized by dividing program codes of the program of the present invention into multiple files and downloading the files from different home pages. In other words, a WWW server that enables multiple users to download program files for realizing the functions and processing of the present invention by the computer is also a component of the present invention.

The programs of the present invention may be encrypted to be stored on a recording medium such as a CD-ROM, and distributed to the users. In this case, only users who satisfy predetermined conditions may be permitted to download key information for decrypting the programs from a home page via the Internet, and decrypt the encrypted programs by the key information to execute the programs, thereby installing the programs in the computers.

The computer may execute the read programs to realize the functions of the embodiments described above. Based on instructions of the programs, the OS operating on the computer may carry out a part or all of actual processing. Needless to say, in this case, the functions of the embodiments described above can be realized.

The programs read from the recording medium may be written in a memory disposed in a function expansion board inserted into the computer or a function expansion unit connected to the computer. Based on instructions of the programs, a CPU disposed in the function expansion board or the function expansion unit may carry out a part or all of actual processing. Thus, the functions of the embodiments described above can be realized.

While the present invention has been described with reference to the aforementioned exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-024502, filed on Feb. 5, 2010, which is hereby incorporated by reference herein in its entirety.

What is claimed is:

1. An image forming apparatus, comprising: an image forming section that forms a non-margin image by forming a toner image on an image bearing member, transferring the toner image formed on the image bearing member to the transfer material and inserting, into a fixing device, the transfer material to which the toner image is transferred, the toner image including an edge portion area in which an edge of a transfer material is to be in the edge portion area and an internal area defined inside the edge portion area; and a processing section that performs toner amount increase processing of increasing a toner amount, wherein on the toner image which corresponds to the edge portion area and is formed on the image bearing member, the processing section performs the toner amount increase processing including toner amount gradual increase processing of gradually increasing the toner amount from an inner side of the edge portion area toward an outer side of the edge portion area, and wherein the image forming section forms the toner image subjected to the toner amount increase processing including the toner amount gradual increase processing in the edge portion area, on the image bearing member.

2. The image forming apparatus according to claim 1, wherein the toner image is formed based on image information, and wherein the image forming apparatus further comprises another processing section that performs an image processing including the toner amount increase processing having the toner amount gradual increase processing on the image information in a portion corresponding to the edge portion area.

3. The image forming apparatus according to claim 1, wherein the toner amount increase processing comprises image processing of increasing a gradation of image information used for forming the toner image in the edge portion area, when the gradation is equal to or higher than a threshold value which is set for determining whether to perform the toner amount increase processing.

4. The image forming apparatus according to claim 1, wherein the edge portion area comprises:

a leading edge portion;

a trailing edge portion;

a right edge portion; and a left edge portion, and the toner amount increase processing is performed on the toner image corresponding to at least one of the leading edge portion, the trailing edge portion, the right edge portion, and the left edge portion.

5. The image forming apparatus according to claim 1, wherein the toner amount increase processing for the toner image in the edge portion area comprises processing of increasing the toner amount of a color relatively lower in visibility compared to a target color that is a target of the toner amount increase processing.

6. The image forming apparatus according to claim 5, wherein the target color is black, and wherein the color relatively lower in visibility is one of yellow, magenta, cyan, and a mixing color obtained from multiple colors of yellow, magenta, and cyan.

7. The image forming apparatus according to claim 5, wherein the toner amount increase processing comprises substituting toner of the color relatively lower in visibility for toner of the target color exceeding a threshold value, to thereby increase the toner amount of the color relatively lower in visibility compared to the target color of an image that is the target of the toner amount increase processing.

8. The image forming apparatus according to claim 1, wherein the toner amount increase processing for the toner image in the edge portion area comprises processing of decreasing the toner amount of a target color that is a target of the toner amount increase processing, and increasing the toner amount of a color relatively lower in visibility compared to the target color.

9. An image information generation method comprising:

generating image information used for forming a non-margin image by forming a toner image on an image bearing member, transferring the toner image formed on the image bearing member to the transfer material and inserting, into a fixing device, the transfer material to which the toner image is transferred, in an image forming apparatus, the toner image including an edge portion area in which an edge of a transfer material is to be in the edge portion area and an internal area defined inside the edge portion area; and performing, on the image information corresponding to the edge portion area, toner amount increase processing of increasing a toner amount of the toner image formed on the image bearing member, the toner amount increase processing including toner amount gradual increase processing of gradually increasing the toner amount from an inner side of the edge portion area toward an outer side of the edge portion area.

10. A computer program for causing a computer to execute processing of:

generating image information used for forming a non-margin image by forming a toner image on an image bearing member, transferring the toner image formed on the image bearing member to the transfer material and inserting, into a fixing device, the transfer material to which the toner image is transferred, in an image forming apparatus, the toner image including an edge portion area in which an edge of a transfer material is to be in the edge portion area and an internal area defined inside the edge portion area; and performing, on the image information corresponding to the edge portion area, toner amount increase processing of increasing a toner amount of the toner image formed on the image bearing member, the toner amount increase processing including toner amount gradual increase processing of gradually increasing the toner amount from an inner side of the edge portion area toward an outer side of the edge portion area.

11. The computer program according to claim 10, which further causes the computer to execute processing of performing control so as to output the image information generated by the toner amount increase processing from the computer to the image forming apparatus.

* * * * *